US010820659B2

(12) United States Patent
Kilgore et al.

(10) Patent No.: US 10,820,659 B2
(45) Date of Patent: Nov. 3, 2020

(54) FUNCTIONAL APERTURES FOR MANUFACTURING REGISTRATION

(71) Applicant: NIKE, Inc., Beaverton, OR (US)

(72) Inventors: Bruce J. Kilgore, Lake Oswego, OR (US); Douglas A. Beye, Beaverton, OR (US); Daniel B. DeHaven, Sherwood, OR (US); Kassio Figur, Portland, OR (US); Jessica Anne Junkins, Portland, OR (US); Sara Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 61 days.

(21) Appl. No.: 15/993,130

(22) Filed: May 30, 2018

(65) Prior Publication Data

US 2018/0343975 A1 Dec. 6, 2018

Related U.S. Application Data

(60) Provisional application No. 62/512,985, filed on May 31, 2017.

(51) Int. Cl.

| | |
|---|---|
| ***A43B 23/02*** | (2006.01) |
| ***A43B 3/00*** | (2006.01) |
| ***A43B 9/02*** | (2006.01) |

(52) U.S. Cl.

CPC ..... *A43B 23/0255* (2013.01); *A43B 3/0036* (2013.01); *A43B 9/02* (2013.01);

(Continued)

(58) Field of Classification Search

CPC ..... A43B 23/0245; A43B 23/0255; A43B 23/0295; A43B 23/02

(Continued)

(56) References Cited

U.S. PATENT DOCUMENTS 260,024 A * 6/1882 Holbrook ..... A43B 7/32 36/72 R
351,778 A * 11/1886 Kelly ..... A43B 23/02 36/48

(Continued)

FOREIGN PATENT DOCUMENTS

CN 101014260 A 8/2007
CN 101108372 A 1/2008

(Continued)

OTHER PUBLICATIONS

International Preliminary Report on Patentability dated Dec. 12, 2019 in International Patent Application No. PCT/US2018/034916, 8 pages.

(Continued)

*Primary Examiner* — Marie D Bays
(74) *Attorney, Agent, or Firm* — Shook, Hardy & Bacon L.L.P.

(57) ABSTRACT

An article of footwear formed from a flat pattern to include a side seam and/or utilizing aperture alignment of multiple flat pattern pieces is disclosed. In aspects, an article of footwear, such as an upper, is formed from a flat pattern and modified into a dimensional article of footwear that includes a side closing. The side closing may comprise adjoined side edges of the flat pattern upper that are secured to each other with a securing element to maintain the dimensional article of footwear in its shape. Alignment of the parts may be provided through at least partial alignment of apertures in the flat pattern upper and apertures in a securing element and/or other flat pattern pieces, including using multi-purpose apertures, allowing streamlined processing and manufacturing of footwear.

10 Claims, 14 Drawing Sheets

(52) U.S. Cl.
CPC ..... *A43B 23/025* (2013.01); *A43B 23/0245* (2013.01); *A43B 23/0295* (2013.01)

(58) Field of Classification Search
USPC ..... 36/45, 47, 48, 57
See application file for complete search history.

(56) References Cited

U.S. PATENT DOCUMENTS

| | | | | |
|---|---|---|---|---|
| 479,251 | A | 7/1892 | Dodge et al. | |
| 1,399,436 | A * | 12/1921 | Little | A43B 23/0295 36/45 |
| 1,839,274 | A * | 1/1932 | Sundean | A43B 23/025 36/54 |
| 2,147,197 | A | 2/1939 | Glidden | |
| 2,535,560 | A * | 12/1950 | Barr | A43B 3/30 36/12 |
| 2,622,052 | A | 12/1952 | Chandler | |
| 3,130,505 | A | 4/1964 | Markevitch | |
| 3,583,081 | A | 6/1971 | Hayashi | |
| 4,438,574 | A * | 3/1984 | Johnson | A43B 23/0235 36/129 |
| 4,593,634 | A | 6/1986 | Moreno | |
| 5,926,976 | A * | 7/1999 | Cretinon | A43B 5/002 36/45 |
| 6,931,762 | B1 | 8/2005 | Dua | |
| 2004/0118018 | A1 | 6/2004 | Dua | |
| 2008/0110048 | A1 | 5/2008 | Dua et al. | |
| 2012/0297642 | A1 | 11/2012 | Schaefer et al. | |
| 2013/0269209 | A1* | 10/2013 | Lang | A43B 23/0235 36/45 |
| 2014/0173932 | A1 | 6/2014 | Bell | |
| 2014/0352173 | A1* | 12/2014 | Bell | A43B 1/00 36/50.1 |
| 2017/0000210 | A1* | 1/2017 | Bigolin | A43C 1/003 |
| 2017/0143059 | A1 | 5/2017 | Gallagher | |
| 2017/0265567 | A1 | 9/2017 | Kilgore | |
| 2017/0273405 | A1 | 9/2017 | Kilgore | |
| 2017/0273406 | A1 | 9/2017 | Kilgore | |
| 2017/0290391 | A1 | 10/2017 | Kilgore | |
| 2017/0347745 | A1 | 12/2017 | Figur et al. | |
| 2017/0347753 | A1 | 12/2017 | Kilgore | |
| 2018/0343975 | A1* | 12/2018 | Kilgore | A43B 23/0255 |

FOREIGN PATENT DOCUMENTS

| | | | |
|---|---|---|---|
| CN | 102711538 | A | 10/2012 |
| CN | 104287311 | A | 1/2015 |
| DE | 2235819 | B2 | 2/1974 |
| EP | 2792265 | A2 | 10/2014 |
| FR | 1109762 | A | 2/1956 |
| JP | 2005160697 | A | 6/2005 |
| WO | 9003744 | A1 | 4/1990 |
| WO | 2015076893 | A1 | 5/2015 |

OTHER PUBLICATIONS

International Search Report and Written Opinion dated Sep. 5, 2018 in International Patent Application No. PCT/US2018/034916, 14 pages.

* cited by examiner

FUNCTIONAL APERTURES FOR MANUFACTURING REGISTRATION

CROSS-REFERENCE TO RELATED APPLICATIONS AND CLAIM OF PRIORITY

This Non-Provisional patent application claims priority benefit of U.S. Provisional Patent Application No. 62/512,985, filed May 31, 2017, titled "Functional Apertures for Manufacturing Registration," the entire contents of which is incorporated herein by reference.

TECHNICAL FIELD

The field relates to continuous in-line manufacturing of footwear from a flat pattern.

BACKGROUND

Manufacturing of footwear has traditionally been a labor-intensive process that involves cutting individual pieces and attaching them together to form an article of footwear. This type of manufacturing process may be batch-like, involving a series of operations that are performed at different times, often by different operators. This start-and-stop-type process can produce inefficiencies in the manufacturing of footwear.

SUMMARY

This summary is intended to provide a high-level overview of this disclosure and to introduce a selection of concepts that are further described below in the detailed description section hereof. This summary is not intended to identify key or essential features of the subject matter of this disclosure, nor is it intended to be used as an aid in isolation to determine the scope of the claimed subject matter.

In brief, and at a high level, aspects of this disclosure relate to continuous in-line manufacturing of footwear from a flat pattern to form a dimensional article of footwear that includes a side seam. Further aspects of this disclosure relate to assembling articles of footwear from flat pattern pieces using aperture alignment for registration of the pieces.

In exemplary aspects, a flat pattern is provided that represents a portion of an article of footwear in a pre-formed state. The flat pattern may be an upper, and may be formed into a dimensional article of footwear through manipulation during a manufacturing process. The dimensional article may be formed to include adjoining medial or lateral side edges that can be secured using a securing element to form a medial or lateral side closing that holds the dimensional article of footwear in its shape. The securing element may be a connecting or backing portion that is overlaid, secured, and/or otherwise integrated with the flat pattern upper adjacent the adjoined side edges. The securing element may include one or more apertures that are at least partially alignable with one or more corresponding apertures formed in the flat pattern upper to allow for registration and alignment of the parts during the assembly process.

In additional aspects, a flat pattern used to form an article of footwear (e.g., a flat pattern upper) may include multi-use apertures formed to provide functionality (e.g., lacing, ventilation, etc.) and also to provide for alignment and registration of one or more flat pattern pieces (e.g., a tongue portion, a collar portion, etc., with the flat pattern upper) for assembly and attachment. Additionally, apertures formed in a flat pattern upper used for alignment and registration of one flat pattern piece may also, at least in part, be useable for alignment and registration of other flat pattern pieces. As such, the re-use and/or re-purposing of apertures in a flat pattern assembly process may limit the number of apertures that need to be formed in the pieces to assemble the article. The alignment of flat pattern pieces may also be facilitated using registration tools having pins spaced to engage aligned apertures of the flat pattern pieces.

In one aspect hereof, an article of footwear with a side seam manufactured from a flat pattern is provided. The article of footwear comprises a flat pattern upper having a top surface and an opposite bottom surface, a toe end and an opposite heel end, and a medial side and an opposite lateral side. The flat pattern upper is formed into a dimensional article of footwear with the top surface forming an exterior portion of the dimensional article of footwear. The dimensional article of footwear includes a side closing comprising an adjoined first side edge and second side edge of the flat pattern upper. The side closing also includes a connecting portion that is secured to the flat pattern upper adjacent the first side edge and the second side edge, the connecting portion having one or more apertures that are at least partially aligned with one or more corresponding apertures formed in the flat pattern upper.

In another exemplary aspect hereof, an article of footwear with a side seam manufactured from a flat pattern is provided. The article of footwear comprises a flat pattern upper having a top surface and an opposite bottom surface, a toe end and an opposite heel end, and a medial side and an opposite lateral side. The flat pattern upper is formed into a dimensional article of footwear with the top surface forming an exterior portion of the dimensional article of footwear. The dimensional article of footwear includes a side closing comprising an adjoined first side edge and second side edge of the flat pattern upper. The side closing includes a backing portion that is secured to at least the bottom surface of the flat pattern upper adjacent the first side edge and the second side edge, the backing portion having one or more apertures that are aligned with one or more corresponding apertures formed in the flat pattern upper.

In another exemplary aspect hereof, a method of manufacturing an article of footwear having a side seam from a flat pattern is provided. The method comprises forming a flat pattern upper having a top surface and an opposite bottom surface, a toe end and an opposite heel end, and a medial side and an opposite lateral side. The method further comprises forming one or more apertures in the flat pattern upper, forming the flat pattern upper into a dimensional article of footwear with the top surface forming an exterior portion of the dimensional article of footwear, and forming a side closing by adjoining a first side edge and a second side edge of the flat pattern upper. The method further comprises providing a connecting portion having one or more apertures that are alignable with the one or more apertures formed in the flat pattern upper, aligning the connecting portion with the side closing by aligning the one or more apertures in the connecting portion with the one or more apertures formed in the flat pattern upper, and securing the aligned connecting portion to the flat pattern upper adjacent the first side edge and the second side edge.

As used herein, the term "article of footwear" includes, but is not limited to, shoes, boots, sandals, and the like, as well as partial assemblies thereof. The term "shoe" will be used herein to generically refer to an article of footwear. It is to be understood that "shoe" is not limited to a certain style, and may include boots, athletic shoes, sandals, running shoes, cleats, dress shoes, and/or other types of footwear. Generally, a shoe is comprised of a ground-contacting portion, which may be referred to as a sole. The sole may be formed from a variety of materials and/or from a variety of individual components. For example, a sole may include an outsole, a midsole, and/or an insole. A shoe may also include a foot-securing portion that can be used to secure a wearer's foot to the sole. The foot-securing portion may be referred to as a shoe upper, or just an upper. An upper may be formed from one or more materials and/or from one or more individual components.

BRIEF DESCRIPTION OF THE FIGURES

The subject matter of this disclosure is described in detail herein with reference to the attached figures, which depict exemplary and non-limiting aspects hereof, in which.

DETAILED DESCRIPTION

The subject matter of this disclosure is described with specificity herein to meet statutory requirements. However, the description is not intended to limit the scope of this disclosure. Rather, the claimed subject matter may be provided in other ways, to include different features, steps, and/or combinations of features and/or steps, similar to the ones described in this disclosure, and in conjunction with other present and/or future technologies. The terms "step" and "block" should not be interpreted as implying any particular order among the elements of methods employed herein unless and except when the order of individual steps or blocks is explicitly described and required.

At a high level, this disclosure relates generally to continuous in-line manufacturing of footwear, or portions thereof, from a flat pattern. The flat pattern may be formed into a dimensional article of footwear that includes a secured side closing (e.g., a medial or lateral side closing). The article of footwear may be constructed from one or more flat pattern pieces aligned and registered for attachment to each other using aperture alignment. In this respect, apertures formed in flat pattern pieces may provide functionality in a formed article of footwear (e.g., for lacing, ventilation, etc.) and also may be re-used and/or re-purposed for alignment and registration of one or more flat pattern pieces for assembly and attachment.

In addition to the materials and techniques used to form such articles, additional shaping, forming, and/or combining and attaching of components may be used to obtain a desired three-dimensional shape (e.g., a dimensional shoe). Traditionally, a tool known as a cobbler's last serves as a shape about which a shoe may be formed to a desired size, shape, and construction. As used herein, the term "last" refers to a tool about which a dimensional shoe upper may be formed. In some aspects, a sole may be coupled (e.g., adhered, stitched, welded, etc.) to the upper as the upper is lasted (i.e., while the last is positioned in an interior volume of the upper). The last may define the contours, shape, style, and/or other characteristics of a resulting shoe.

Figure 1:
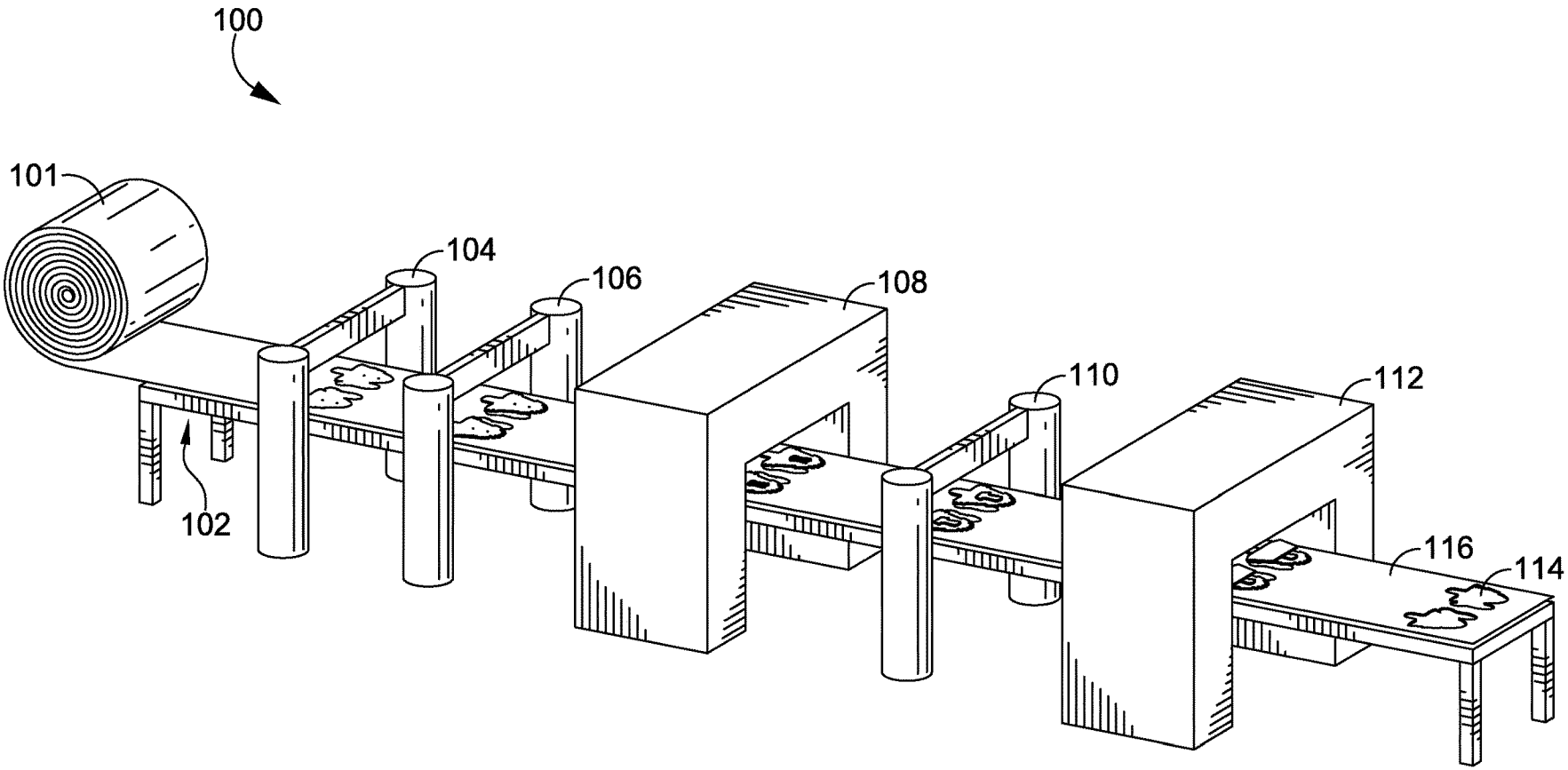
FIG. 1 depicts an exemplary in-line manufacturing process for forming an article of footwear from a flat pattern, in accordance with an aspect hereof.
Figure 2:
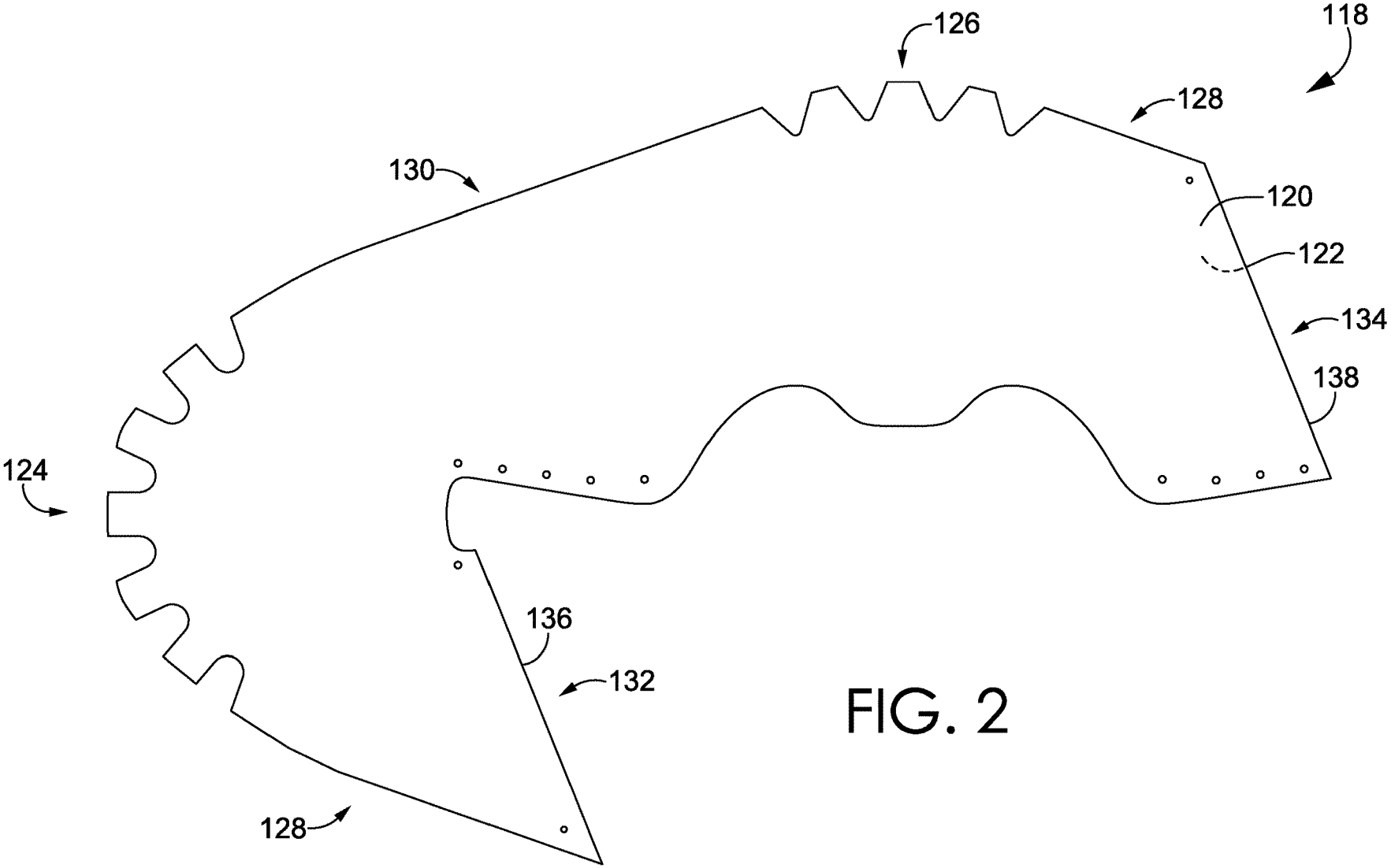
FIG. 2 depicts an exemplary flat pattern upper, in accordance with an aspect hereof.

As used in this disclosure, "flat pattern" shall mean a substantially planar collection of materials, as generally depicted in FIGS. 1-2, that may be modified or shaped before being formed into a desired dimensional article of footwear, or portion thereof (e.g., an upper with a desired height, size, etc.). While different materials may be coupled to one another in a manner that forms textures, bumps, embossing, protrusions, and the like on the flat pattern, the collection of materials is still considered substantially planar, and therefore is considered "flat" even with such deviations in height and texture along the surface. The flat pattern, once formed about a last to create a receiving cavity in which a wearer's foot may be received, becomes a "dimensional article of footwear."

In exemplary aspects, a dimensional article of footwear is one that is formed so that it can be secured to and around a portion of a wearer (e.g., a wearer's foot). A "flat" pattern, in contrast to a "dimensional" article, is not formed to be received about a portion of a wearer (e.g., the wearer's foot). It should be noted that a "dimensional article of footwear" does not necessarily mean a fully formed article of footwear (e.g., a dimensional article of footwear may only be an upper without an attached sole, sockliner, underfoot portion, interior liner, etc.).

The concept of a flat pattern is conducive to manufacturing, as many materials used to form a shoe upper are rolled or flat goods that are in a substantially planar (e.g., sheet-like) configuration in their raw state. Accordingly, construction of a shoe upper from a collection of flat components in an in-line manufacturing process may be advantageous from a material use, construction, and assembly efficiency standpoint. Furthermore, continuous in-line manufacturing allows for strategic implementation of engineered material properties, such as tensile strength, elongation characteristics, and moisture transportation, in an efficient manner on a flat pattern. The flat pattern concept may also provide greater consistency in manufacturing and greater ability to implement machines relative to a traditional dimensional upper manufacturing process. Additionally, variations in size, style, and/or materials used in shoe uppers are possible with an in-line manufacturing process, including within the same in-line manufacturing process.

It is also contemplated that an in-line manufacturing process may be automated so that one or more processes along the manufacturing line are performed by machines that are programmed to complete one or more specific tasks. Additionally, or alternatively, it is contemplated that one or more processes of the in-line manufacturing process may be performed manually by a human operator. Accordingly, in exemplary aspects, any combination of machine and human involvement may be implemented to achieve the formation of an article (e.g., a shoe upper).

Exemplary in-Line Manufacturing System

FIG. 1 depicts an exemplary in-line manufacturing process used to form an article of footwear from a flat pattern, in accordance with an aspect hereof. More specifically, FIG. 1 depicts a continuous in-line production system 100 that utilizes a substrate 101 to form an article of footwear. The substrate 101 may be used as a foundation from which the article of footwear may be formed, and may be selected to provide a level of stretch that allows for registration and positioning of materials on the substrate 101. A tracking system (e.g., that includes cameras, vision systems, sensors, and/or other tracking components) may be used with the production system 100 to monitor the location of the substrate 101 and/or monitor the modifications to the same.

The substrate 101 used in the production system 100 may be of any width and/or of any length. In one aspect, the substrate 101 is a rolled good that has a width sufficient to form at least one, two, three, four, five, or six flat pattern uppers across the width of the substrate 101. The substrate 101 may also have a width sufficient to form at least two flat pattern uppers in a common operation to provide matching articles of footwear. Each of the footwear flat patterns formed in the continuous in-line manufacturing process may represent a common, or different, style, shape, size, and/or configuration of a shoe upper from the next footwear flat pattern.

The substrate 101 may be of any material, including, as shown in the exemplary aspect depicted in FIG. 1, a sheet material. For example, the substrate 101 may be a non-woven fabric that is a sheet or web-like structure formed through entanglement of fibers/filaments by mechanical, thermal, and/or chemical processes. The non-woven material may be a flat and porous material that is non-woven or non-knit. The non-woven material may also be formed from recycled materials, such as scrap materials generated from the in-line manufacturing process itself. Additionally, a non-woven material may be a polymer-based material, such as polyurethane ("PU") or thermoplastic polyurethane ("TPU"). The non-woven material may be a web material, such as an industrial felt that is fabricated by a needle felting of polyester fibers. The substrate 101 may also, in other aspects, be a knitted or woven material, or may be a combination of knitted/woven materials and/or non-woven/non-knitted materials, and may include the same that is retrieved from the manufacturing process itself.

It is contemplated that the substrate 101, whether formed from a non-woven material or another material (e.g., a woven or knitted material), may be formed from one or more synthetic fibers, natural fibers, or a combination of the same. In one aspect, such fibers may be captured from the manufacturing process as part of a waste stream. For example, portions of the substrate 101 not used to form an article (e.g., a shoe upper) may be collected from the waste stream following the formation of the article, and may be recycled to once again form the substrate 101 for a subsequent manufacturing process. As such, recycling the substrate 101 may provide economic efficiencies in the manufacturing process. This is particularly true when the substrate 101 is a non-woven material formed from a random entanglement of fibers, rather than a knit or a woven material with specific engineered structures (e.g., interlacing, looping, etc.).

The substrate 101 may alternatively be formed from a woven or knit material. For example, it is contemplated that the substrate 101 may be formed from an in-line knit or in-line woven material such that the substrate 101 begins as a yarn, fiber, thread, or other raw material, and then is formed into a sheet-like construction as part of the in-line manufacturing process. Alternatively, it is contemplated that the substrate 101 is formed into a sheet-like format by knitting or weaving prior to being introduced to the in-line manufacturing process.

Returning to FIG. 1, the substrate 101 is depicted progressing along a series of processing stations positioned along the in-line production system 100. More specifically, the production system 100 includes a conveyor system 102 that advances the substrate 101 and a series of processing stations 104, 106, 108, 110, and 112 at which the substrate 101 may be manipulated and/or modified during the manufacturing process. It is contemplated that the production system 100 may run in a continuous fashion, providing various modifications to each flat pattern until it is removed from the conveyor system 102. As such, it is contemplated that a portion of the substrate 101 will form a portion of a removed upper. FIG. 1 depicts an exemplary flat pattern upper outline 114 that has been extracted from the substrate 101, along with a waste portion 116. In certain aspects, the waste portion 116 may be recycled for use in forming other flat pattern uppers by reintegrating the waste portion 116 into the substrate 101.

The production system 100, including the conveyor system 102 and the processing stations 104, 106, 108, 110, and 112, are exemplary in nature and different processing configurations are contemplated. Similarly, an exemplary flat pattern upper outline 114 is depicted in FIG. 1, but other types of flat patterns are contemplated. It should be understood that any combination, spacing, sequence, and configuration of components may be used in the production system 100 to accomplish aspects provided herein. In this respect, the processing stations, such as the processing stations 104, 106, 108, 110, and 112, may be, but are not limited to, printing stations, liquid application stations, heat application stations, steam application stations, cutting stations, punching stations, part-moving/part-adjusting stations, sewing stations, adhesive application stations, welding stations, vision and part-recognition/analysis stations, and the like. Furthermore, it is contemplated that one or more stations may be combined into a common station that performs multiple operations at a common location and/or at a common time. It is also contemplated that one or more stations may be human occupied so that an operation may be performed by a human absent or in connection with the production system 100.

While specific components and processes are depicted in connection with the system 100 depicted in FIG. 1, it is to be understood that any processes (e.g., cutting, coupling, painting, printing, applying, forming, and the like) may be performed in any sequence and in any number. Additionally, while specific components are depicted, it is contemplated that any combination, shape, ordering, and/or configuration of components may be implemented with the in-line manufacturing system in accordance with aspects of this disclosure.

Forming an Article of Footwear Having a Side Seam

Referring to FIG. 2, an exemplary flat pattern upper 118 is provided, in accordance with an aspect hereof. The flat pattern upper 118 may be formed or cut from a base material such as, for example, the substrate 101 depicted in FIG. 1. The flat pattern upper 118 may be formed so as to enable it to be manipulated into a dimensional article of footwear (e.g., a dimensional upper that can be attached to a sole, sockliner, underfoot portion, etc.). The flat pattern upper 118 includes a top surface 120 and an opposite bottom surface 122 (which is opposite to the side depicted in FIG. 2), a toe end 124 and an opposite heel end 126, and a medial side 128 and an opposite lateral side 130. In FIG. 2, the flat pattern upper 118 has not yet been modified into a dimensional article of footwear, and is therefore in a lay-flat configuration. As such, the medial side 128 is actually separated into a first medial side 132 and a second medial side 134 that are, in the lay-flat configuration shown in FIG. 2, separated and non-adjoined other than across the lateral side 130 of the flat pattern upper 118. The first medial side 132 includes a first medial edge 136, and the second medial side 134 includes a second medial edge 138.

It should be understood that, with respect to FIG. 2 and the flat pattern upper 118, different modifications and manipulations of the flat pattern upper 118 may occur at different stages of an in-line manufacturing process. As such, the flat pattern upper 118 depicted in FIG. 2 is but one aspect, taken from one stage of an in-line manufacturing process, and is not necessarily in a final form. Rather, additional processes, such as cutting, welding, attaching of materials, forming and shaping, and/or other manipulative processes may be applied to the flat pattern upper 118 at other stages.

Figure 3:
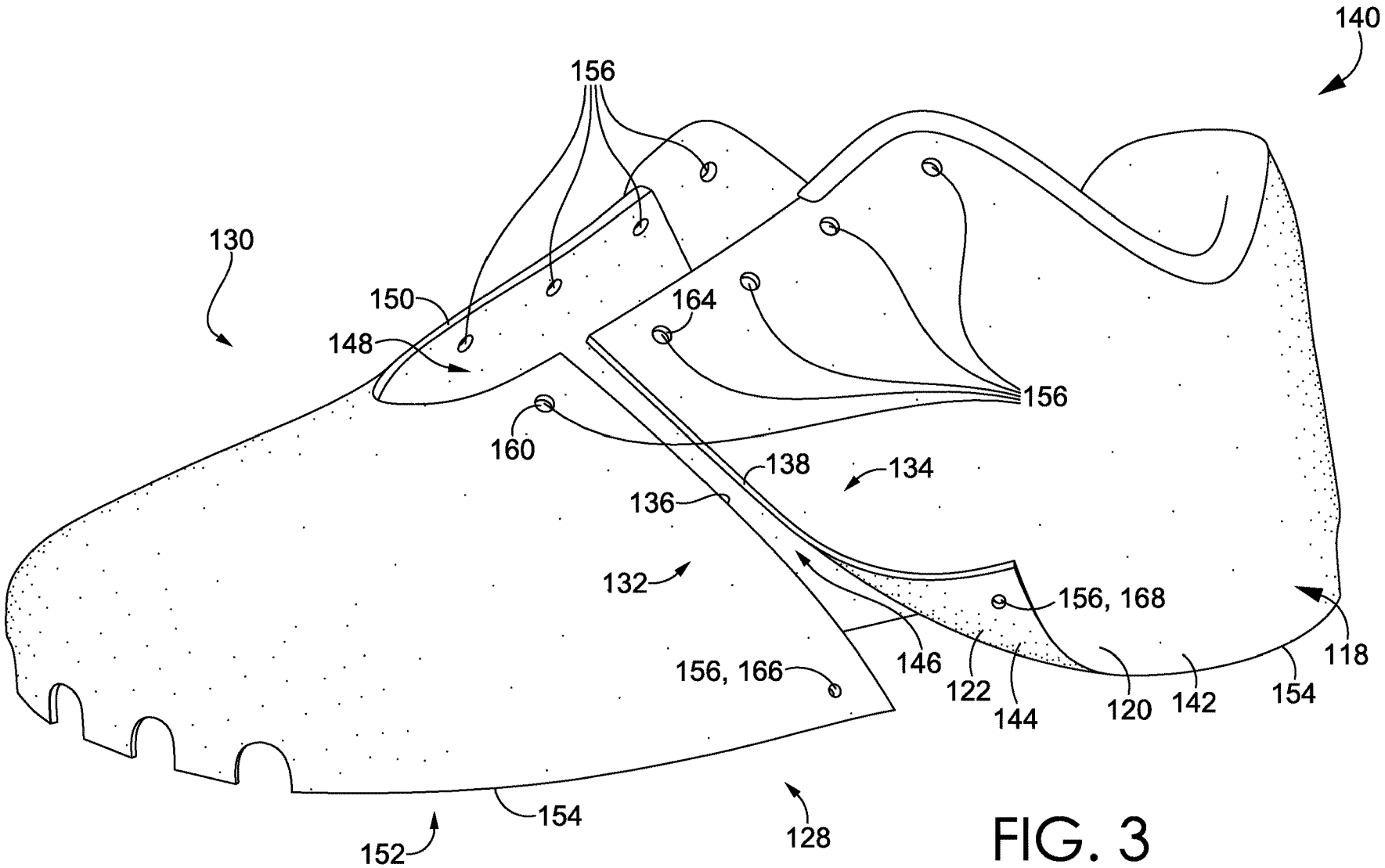
FIG. 3 depicts the flat pattern upper of FIG. 2 formed into a dimensional article of footwear viewed from the medial side, in accordance with an aspect hereof.

Referring to FIG. 3, the flat pattern upper 118 depicted in FIG. 2 is shown formed into a dimensional article of footwear 140, in accordance with an aspect hereof. In FIG. 3, the top surface 120 of the flat pattern upper 118 forms an exterior portion 142 of the dimensional article of footwear 140, and the bottom surface 122 forms an interior portion 144 of the dimensional article of footwear 140. Additionally, the first medial edge 136 of the first medial side 132 and the second medial edge 138 of the second medial side 134 have been adjoined, or rather, brought within proximity of each other (e.g., have been brought within 1 inch, ½ inch, ¼ inch, ⅛ inch, or 1/16 inch of each other, or are directly abutting each other in contact) for securement in order to form a medial side closing 146 in the dimensional article of footwear 140.

The dimensional article of footwear 140 includes a throat portion 148 having a throat edge 150 that extends around the throat portion 148 from the medial side 128 to the lateral side 130, and a perimeter portion 152 having a perimeter edge 154 that extends around the perimeter portion 152 from the medial side 128 to the lateral side 130 opposite to the throat edge 150. The flat pattern upper 118 also includes a plurality of apertures 156 which may, in certain aspects, be used for registration and alignment of a securing element that is attached to the flat pattern upper 118 to secure the first medial side 132 to the second medial side 134 so that the dimensional article of footwear 140 can, at least partially, retain its shape. Exemplary securing elements (e.g., a connecting portion, a backing portion, etc.) are discussed in further detail with respect to FIGS. 4A-4B and 5A-5B.

The first medial side 132 and the second medial side 134 each include apertures for alignment. The first medial side 132 includes a first aperture 160 that extends through the flat pattern upper 118, and the second medial side 134 includes a second aperture 164 that extends through the flat pattern upper 118 as well. As shown in FIG. 3, the first aperture 160 is spaced from the first medial edge 136 and the throat edge 150, such that it is located adjacent the throat edge 150 (i.e., is located closer to the throat edge 150 than to the perimeter edge 154). The second aperture 164 is spaced from the second medial edge 138 and the throat edge 150, such that it is located adjacent the throat edge 150 (i.e., is located closer to the throat edge 150 than to the perimeter edge 154).

The first medial side 132 further includes a third aperture 166 spaced from the first medial edge 136 and the perimeter edge 154, such that it is located adjacent the perimeter edge 154 (i.e., is located closer to the perimeter edge 154 than to the throat edge 150). The second medial side 134 further includes a fourth aperture 168 spaced from the second medial edge 138 and the perimeter edge 154, such that it is located adjacent the perimeter edge 154 (i.e., is located closer to the perimeter edge 154 than to the throat edge 150). The throat portion 148 may also include, during later processing steps, a throat overlay (see the exemplary throat overlay 170 depicted in FIG. 4A) that aligns with the flat pattern upper 118. The perimeter portion 152 may further include a perimeter overlay which may, for example, be a discrete portion of material, or which may be a portion of a sole attached to the dimensional article of footwear 140.

Additionally, although FIGS. 2-3 depict a flat pattern upper formed into a dimensional article of footwear with a medial side closing, it is contemplated in additional aspects that a flat pattern upper may be configured to be formed into a dimensional article of footwear with a lateral side closing (e.g., having adjoined and secured lateral side edges) with similarly discussed securing elements used for securing the adjoined lateral side edges.

Figure 4A:
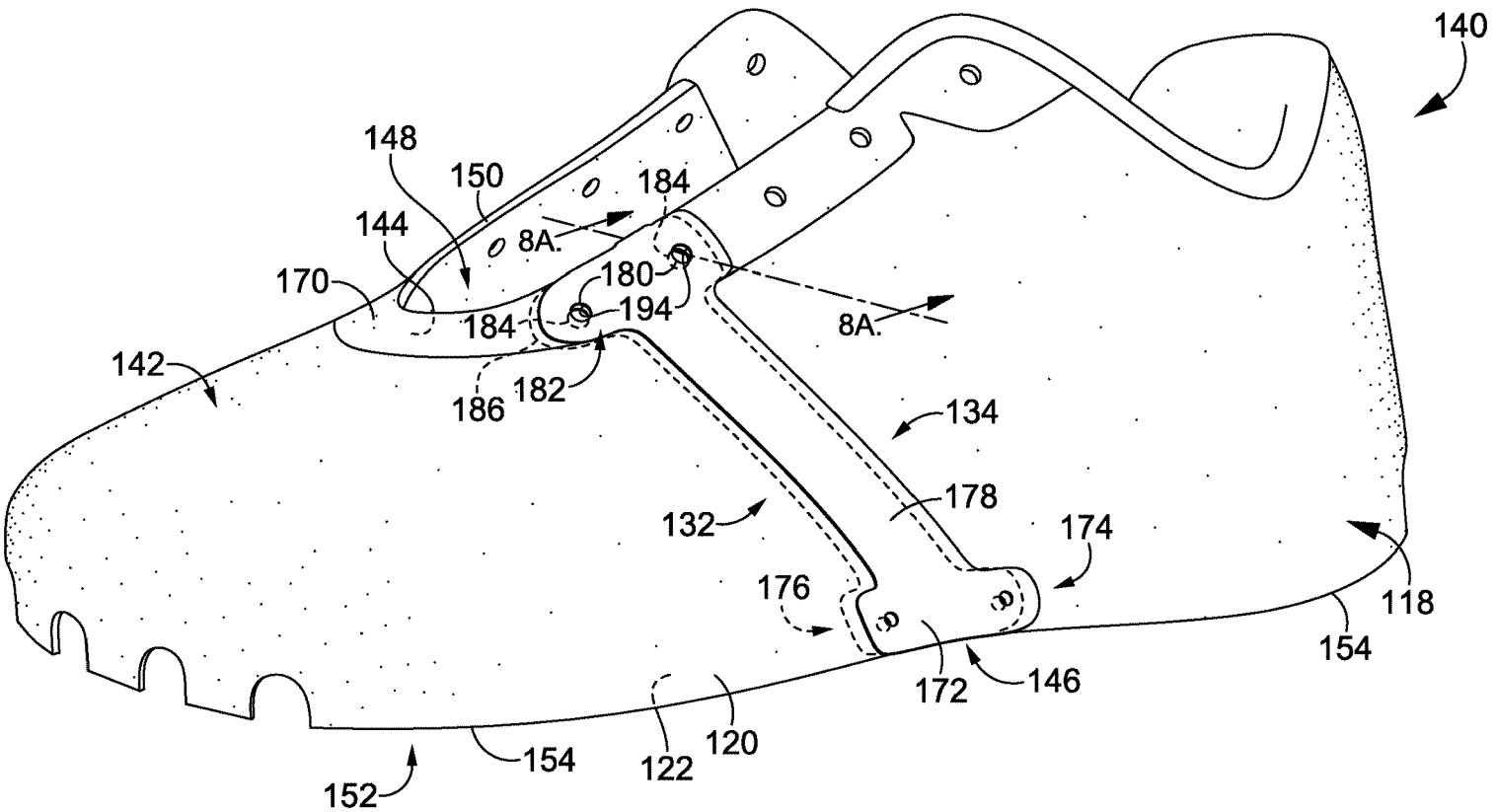
FIG. 4A depicts the dimensional article of footwear of FIG. 3 with a connecting portion secured to a medial side closing, in accordance with an aspect hereof.

Referring to FIG. 4A, the dimensional article of footwear 140 of FIG. 3, depicted with a connecting portion 172 attached to secure the medial side closing 146, is provided, in accordance with an aspect hereof. The exemplary connecting portion 172 depicted in FIG. 4A is shown in isolation in FIG. 4B for greater clarity. In FIG. 4A, the connecting portion 172 is shown layered over and attached to the flat pattern upper 118 to cover the top surface 120, the bottom surface 122, and the throat edge 150. The connecting portion 172 also at least partially covers the adjoined first and second medial edges 136, 138 of the flat pattern upper 118 shown in FIG. 3.

Figure 4B:
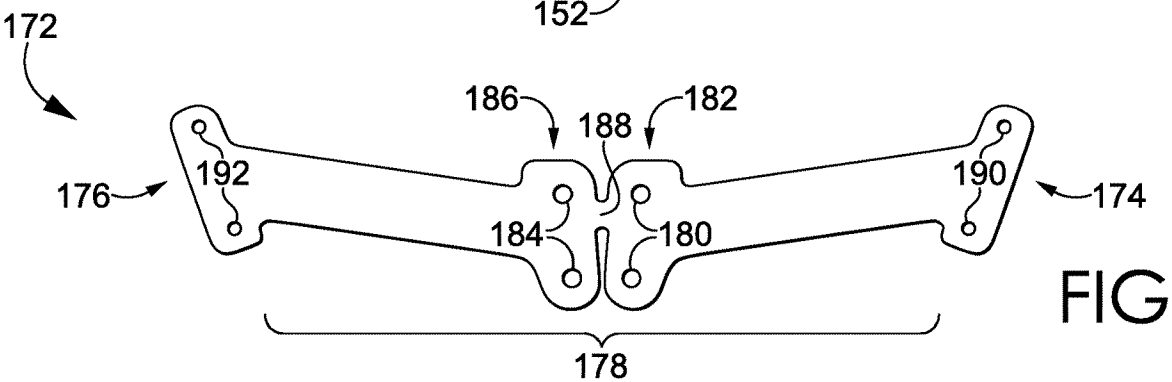
FIG. 4B depicts the connecting portion of FIG. 4A in isolation, in accordance with an aspect hereof.

The connecting portion 172, which is depicted in FIGS. 4A-4B as an elongated strip of material having a first end 174, a second end 176, and an intervening portion 178, includes a plurality of apertures positioned such that they are alignable with corresponding apertures formed in the flat pattern upper 118 (e.g., the first, second, third, and fourth apertures 160, 164, 166, and 168 shown in FIG. 3). In the aspect depicted in FIG. 4A, the adjoined first and second medial edges 136, 138, the medial side closing 146, and the connecting portion 172 extend from the throat portion 148 to the perimeter portion 152 at an angle that is non-perpendicular to both the throat edge 150 and the perimeter edge 154. It is contemplated that the connecting portion 172 may be perpendicular or non-perpendicular with respect to each of the throat edge 150 and the perimeter edge 154 in different aspects.

Referring to FIG. 4B, the exemplary connecting portion 172 of FIG. 4A is depicted in isolation, in accordance with an aspect hereof. The connecting portion 172 includes a first pair of apertures 180 extending through a first part 182 of the connecting portion 172. As shown in FIG. 4A, the first part 182 overlays the exterior portion 142 of the dimensional article of footwear 140 (i.e., overlays the top surface 120 of the flat pattern upper 118). The connecting portion 172 further includes a second pair of apertures 184 extending through a second part 186 of the connecting portion 172. As shown in FIG. 4A, in dotted lines, the second part 186 overlays the interior portion 144 of the dimensional article of footwear 140 (i.e., overlays the bottom surface 122 of the flat pattern upper 118).

Referring to FIG. 4A, the first pair of apertures 180 and the second pair of apertures 184 are positioned on the connecting portion 172 such that when the connecting portion 172 is aligned with the medial side closing 146, the first pair of apertures 180 respectively align, at least partially, with the first and second apertures 160, 164 formed in the flat pattern upper 118 (shown in FIG. 3), and also, the second pair of apertures 184 respectively align, at least partially, with the first and second apertures 160, 164 formed in the flat pattern upper 118 (shown in FIG. 3). The first and second pairs of apertures 180, 184 are therefore also aligned with each other. This alignment allows the connecting portion 172 to be appropriately positioned and registered on the flat pattern upper 118 for attachment at the medial side closing 146 during the manufacturing and assembly process. In addition, the portion 188 joining the first and second parts 182, 186 of the connecting portion 172 is folded over the throat edge 150.

To further provide registration and alignment of the parts, the first end 174 of the connecting portion 172 includes a third pair of apertures 190 that respectively align, at least partially, with the third and fourth apertures 166, 168 in the flat pattern upper 118 (shown in FIG. 3) adjacent the perimeter edge 154. The alignment of the third pair of apertures 190 allows the first end 174 of the connecting portion 172 to be aligned with the medial side closing 146 on the exterior portion 142 of the dimensional article of footwear 140 (i.e., on the top surface 120) adjacent the perimeter edge 154. The second end 176 of the connecting portion 172 further includes a fourth pair of apertures 192 that respectively align, at least partially, with the third and fourth apertures 166, 168 formed in the flat pattern upper 118, allowing the second end 176 of the connecting portion 172 to be aligned with the medial side closing 146 on the interior portion 144 of the dimensional article of footwear 140 (i.e., on the bottom surface 122) adjacent the perimeter edge 154. Accordingly, the alignment of the third and fourth pairs of apertures 190, 192 with the respective third and fourth apertures 166, 168 in the flat pattern upper 118 adjacent the perimeter edge 154 allows for registration and alignment of the first and second ends 174, 176 of the connecting portion 172 with the medial side closing 146 during the manufacturing and assembly process. It should be understood that "alignment" of apertures as discussed herein may refer to partial alignment, or complete alignment, of the corresponding apertures.

As a result, as depicted in FIG. 4A, the connecting portion 172 overlays and is attached to the exterior portion 142 along the medial side closing 146 (as shown in solid lines), and also, overlays and is attached to the interior portion 144 along the medial side closing 146 (as shown in dotted lines). This alignment provides for correct positioning of the parts during assembly, and may also facilitate, in some aspects, assembly in an automated fashion (e.g., placement and attachment of parts using part pickup, placement, and attachment tools, in addition to other tools or human-based manipulation).

The connecting portion 172 may be secured to the flat pattern upper 118 at the medial side closing 146 using thermal bonding, pressure bonding, welding (e.g., ultrasonic welding), stitching, sewing, chemical or adhesive bonding, fiber entanglement, and/or any other suitable securing, joining, and/or bonding process. The securement may also be provided in an automated fashion using one or more part-attachment tools, or may be provided through some level of human involvement, or by some combination of the same.

FIG. 4A further depicts the throat overlay 170 secured to the flat pattern upper 118 adjacent to the throat edge 150. The throat overlay 170 may overlay and be attached to one or both of the top surface 120 and the bottom surface 122 of the flat pattern upper 118 to provide reinforcement at the throat edge 150 (e.g., to resist forces applied from lacing the article of footwear). In addition, the throat overlay 170 may be positioned, as shown in FIG. 4A, so that the connecting portion 172 at least partially covers and secures the throat overlay 170 against the flat pattern upper 118. The throat overlay 170 includes a pair of throat apertures 194 that are respectively alignable with the first and second apertures 160, 164 formed in the flat pattern upper 118 (as shown in FIG. 3), as well as with the first and second pairs of apertures 180, 184 formed in the connecting portion 172. This allows for registration and alignment of the throat overlay 170 with both the flat pattern upper 118 and the connecting portion 172 during assembly of the article.

It should be noted that the exemplary flat pattern upper 118 depicted in FIGS. 3 and 4A includes an exemplary number of apertures in exemplary locations, and the exemplary connecting portion 172 shown in FIG. 4B includes an exemplary number of apertures positioned to align with the apertures in the flat pattern upper 118. However, it should be understood that numerous other configurations are possible, including those with differing numbers, sizes, arrangements, and patterns of apertures. Additionally, the medial side closing 146 shown in the aspect in FIG. 4A is exemplary, and a medial side closing of a different size, length, angle, position, and/or utilizing a different configuration of aperture alignments, etc., is contemplated herein. Furthermore, one or more connecting portions may be overlaid and secured to an exterior portion, an interior portion, edges, or any combination of the same of an article in different aspects, and a connecting portion may be of different shapes, sizes, or aperture configurations. Additionally, in some aspects, one or more medial side closings with separate or interconnected connecting portions may be provided. Alternatively, no connecting portion may be used, and the edges may instead be secured to each other with any desired attachment method, including those described herein.

Figure 5A:
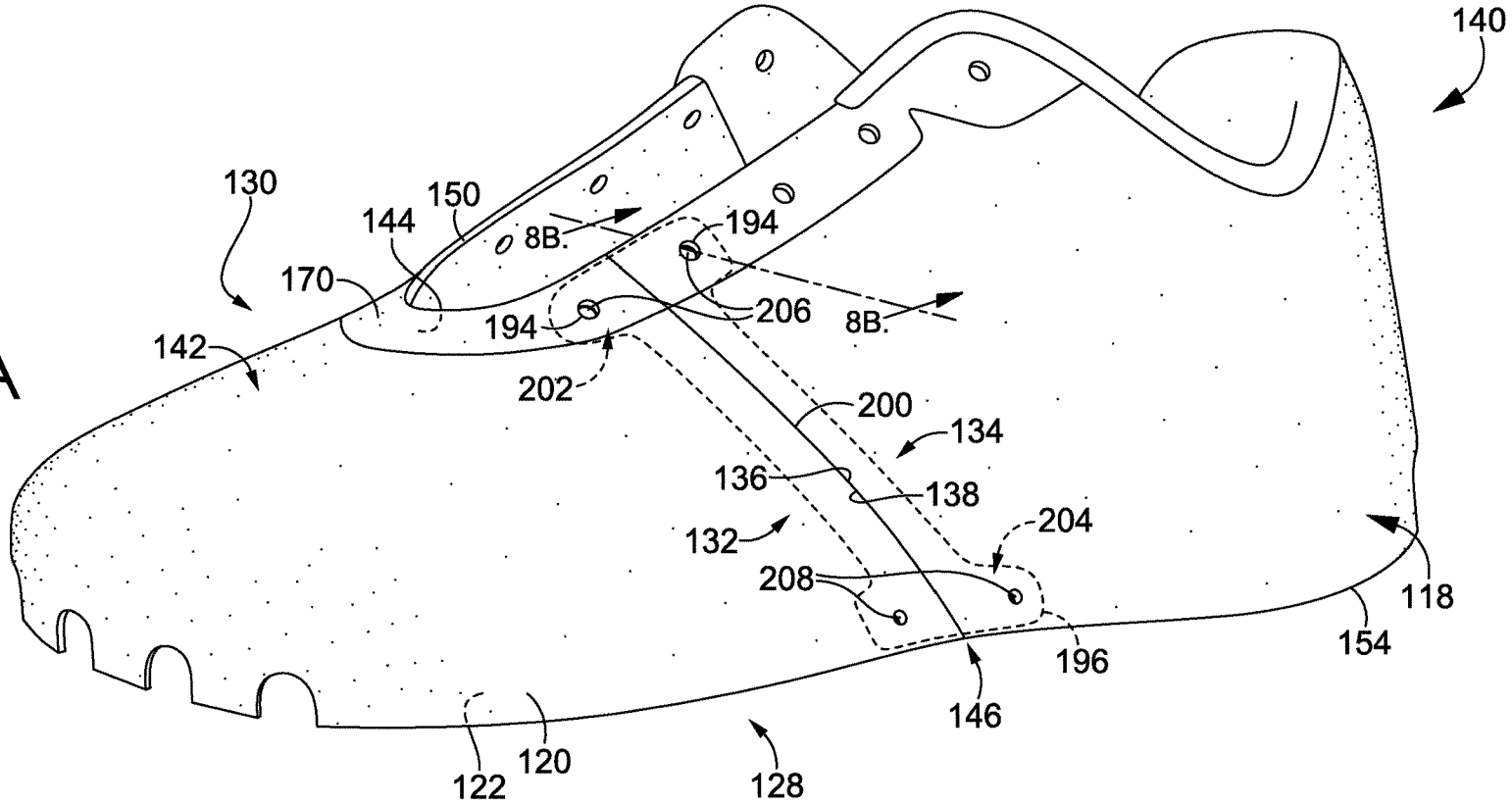
FIG. 5A depicts the dimensional article of footwear of FIG. 3 with a backing portion attached to a medial side closing, in accordance with an aspect hereof.

Referring to FIG. 5A, the dimensional article of footwear 140 of FIG. 3 with a backing portion 196 securing the medial side closing 146 is provided, in accordance with an aspect hereof. The backing portion 196 extends along the medial side closing 146 on the bottom surface 122 of the flat pattern upper 118, or rather, on the interior portion 144 of the dimensional article of footwear 140. As such, the configuration depicted in FIG. 5A provides a medial side closing 146 with less overlaying material on the exterior portion 142 of the dimensional article of footwear 140. The backing portion 196 may still be secured, like the connecting portion 172, to the flat pattern upper 118 using any desired process, material, and/or structure (e.g., using thermal bonding, pressure bonding, adhesive or chemical bonding, welding, etc., as well as any of the same using an automated part-attachment tool).

As shown in FIG. 5A, the first and second medial edges 136, 138 of the flat pattern upper 140 are adjoined, and the backing portion 196, shown in dotted lines to represent its position on the interior portion 144 of the dimensional article of footwear 140, is aligned and attached to the flat pattern upper 118 along the medial side closing 146. The adjoined first and second medial edges 136, 138 form a seam 200 which may be exposed, concealed, or partially exposed and concealed, in different aspects. Additional materials and treatments may be applied to the flat pattern upper 118 that cover, obscure, blend, and/or integrate this seam 200. For example, during the continued manufacturing process, the flat pattern upper 118 may be further modified with an overlay on the medial side 128 that covers the seam 200, whether to provide reinforcement, additional utility (e.g., reduction in stretch properties), or to provide an additional aesthetic element (e.g., a proprietary logo, design, etc.).

Figure 5B:
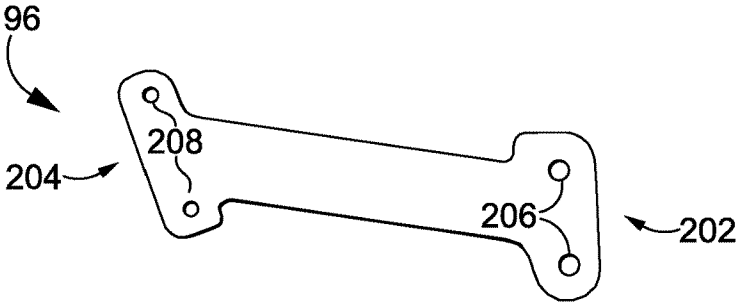
FIG. 5B depicts the backing portion of FIG. 5A in isolation, in accordance with an aspect hereof.

Referring to FIG. 5B, the backing portion 196 is provided in isolation, in accordance with an aspect hereof. It should be noted that, once again, the size, shape, thickness, material, aperture configuration, etc., of the backing portion 196, like the connecting portion 172, may be varied as desired, and as such, the configuration shown in FIG. 5B is merely exemplary. The backing portion 196 includes a first end 202 and a second end 204. As shown in FIG. 5A, the first end 202 is secured to the bottom surface 122 of the flat pattern upper 118 adjacent to the throat edge 150 (i.e., closer to the throat edge 150 than to the perimeter edge 154) and the second end 204 is secured to the bottom surface 122 of the flat pattern upper 118 adjacent to the perimeter edge 154 (i.e., closer to the perimeter edge 154 than to the throat edge 150). The backing portion 196 is depicted in FIG. 5A with dotted lines to show its relative positioning on the dimensional article of footwear 140.

Like the connecting portion 172 shown in FIGS. 4A-4B, the backing portion 196 includes apertures for alignment and registration with the flat pattern upper 118. More specifically, the backing portion 196 includes a first pair of mating apertures 206 located at the first end 202 that are respectively alignable with the first and second apertures 160, 164 formed in the flat pattern upper 118 (as shown in FIG. 3), and a second pair of mating apertures 208 located at the second end 204 that are respectively alignable with the third and fourth apertures 166, 168 formed in the flat pattern upper 118 (as shown in FIG. 3). As with the aspect depicted in FIG. 4A, utilization of this aperture alignment during assembly of the article may allow for a more streamlined, and in some aspects, automated placement, alignment, and attachment of components.

FIG. 5A further depicts a throat overlay 170 that includes a pair of throat apertures 194 that are alignable with the corresponding first and second apertures 160, 164 in the flat pattern upper 118 (as shown in FIG. 3) to allow for registration and alignment of the throat overlay 170 with the flat pattern upper 118. Alignment of the pair of throat apertures 194 may allow, during the manufacturing process, the flat pattern upper 118, the backing portion 196, and the throat overlay 170 to be aligned for attachment. The throat overlay 170 may be secured against the flat pattern upper 118 at least partially by the backing portion 196, or the throat overlay 170 may only overlay the exterior portion 142 of the dimensional article of footwear 140, and the backing portion 196 may overlay the interior portion 144 of the dimensional article of footwear 140, in aspects. Once registration and alignment have been obtained, the backing portion 196 and the flat pattern upper 118 (and optionally, additional components, such as the throat overlay 170) may be secured to each other using one or more joining processes, such as adhesive bonding, thermal bonding, pressure bonding, welding (e.g., ultrasonic welding), or another suitable method.

Figure 10:
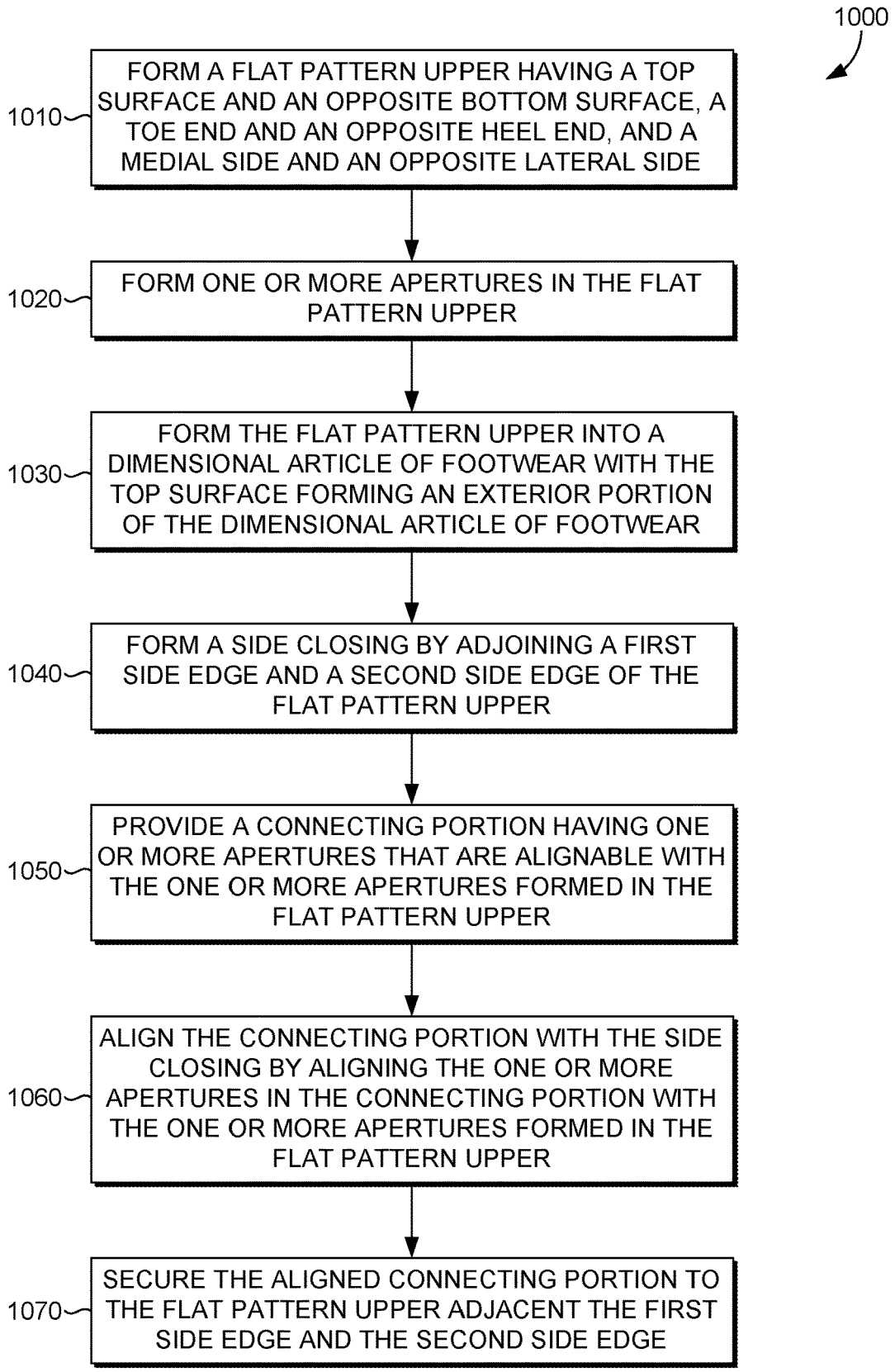
FIG. 10 depicts a block diagram of an exemplary method of manufacturing an article of footwear from a flat pattern, in accordance with an aspect hereof.

It should be noted that, in alternative aspects, the backing portion 196 may instead be attached to the flat pattern upper 118 on the exterior portion 142 of the dimensional article of footwear 140 to cover and secure the medial side closing 146 (see FIG. 10). The backing portion 196 may therefore be positioned to at least partially cover and/or obscure the seam 200 on the exterior portion 142, and may be used in addition to other overlays and/or materials layered on the exterior portion 142. Attachment methods similar to those described herein may be used to provide securement in this configuration.

Figure 6:
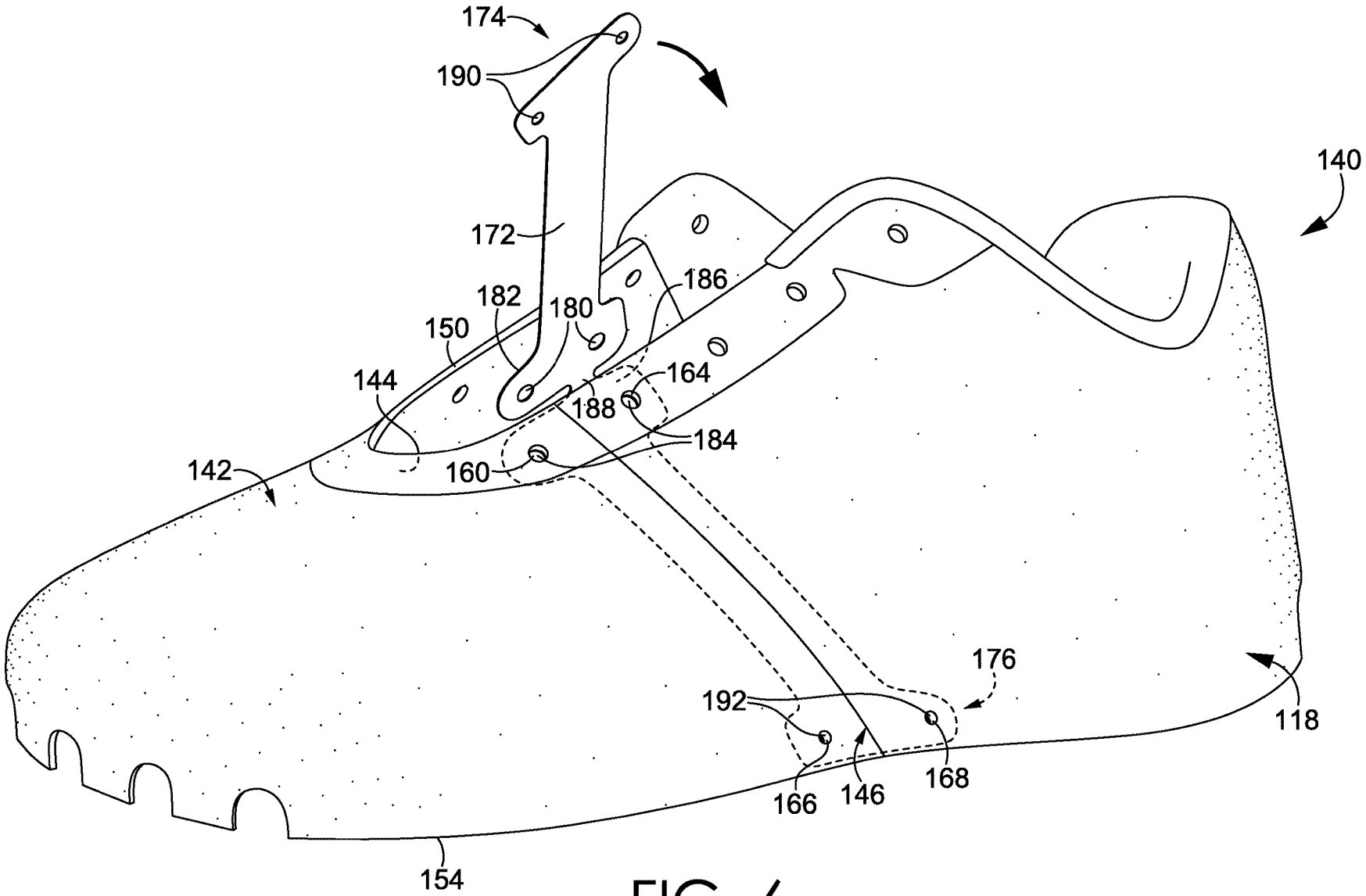
FIG. 6 depicts the dimensional article of footwear of FIG. 3 with the connecting portion being layered over and aligned with the medial side closing for attachment, in accordance with an aspect hereof.

Referring to FIG. 6, the dimensional article of footwear 140 of FIG. 3 with the connecting portion 172 of FIGS. 4A-4B being layered over and aligned for securement at the medial side closing 146 is provided, in accordance with an aspect hereof. In FIG. 6, the connecting portion 172 has been placed such that it extends from the interior portion 144 to the exterior portion 142 of the dimensional article of footwear 140, being folded over the top surface 120, the bottom surface 122, and the throat edge 150. The first and second pairs of apertures 180, 184 of the connecting portion 172 are each respectively aligned with the first and second apertures 160, 164 in the flat pattern upper 118 towards the top of the medial side closing 146 (i.e., adjacent the throat edge 150), and the third and fourth pairs of apertures 190, 192 are each respectively aligned with the third and fourth apertures 166, 168 in the flat pattern upper 118 towards the bottom of the medial side closing 146 (i.e., adjacent the perimeter edge 154). In various aspects, this aligning process may utilize aligning pins, vision systems, and/or other systems to facilitate and confirm a desired level of alignment of the parts during assembly.

Figure 7:
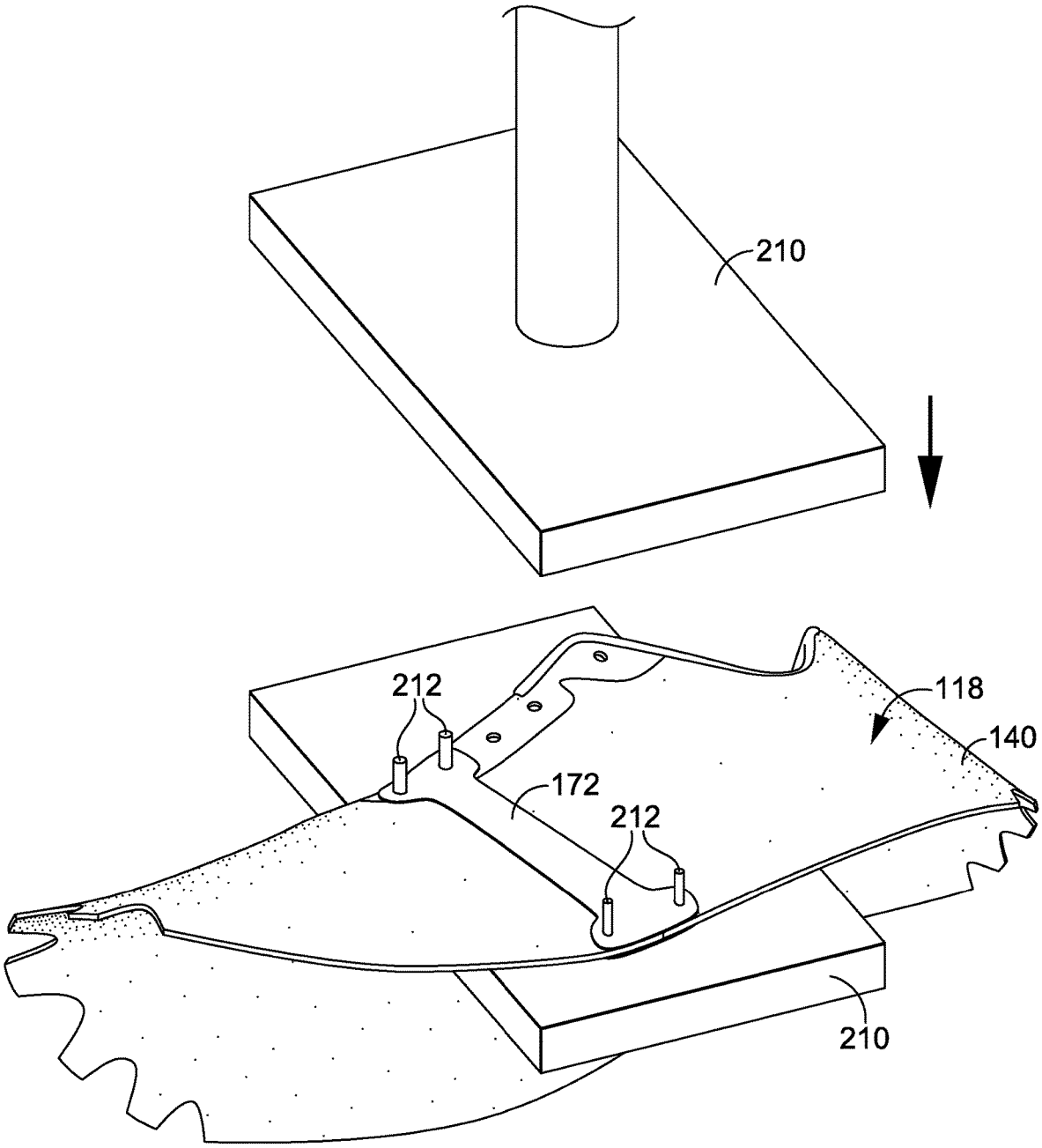
FIG. 7 depicts the dimensional article of footwear of FIG. 3 with the connecting portion of FIG. 4B being secured thereon using a part-attachment tool, in accordance with an aspect hereof.

Referring to FIG. 7, the dimensional article of footwear 140 of FIG. 3 with the connecting portion 172 of FIG. 4B positioned for attachment using a part-attachment tool 210 is provided, in accordance with an aspect hereof. The part-attachment tool 210 may be configured to apply any one or more of pressure, heat, vibration, or the like to the aligned and stacked materials positioned within the part-attachment tool 210 to attach them. The stacked materials may be maintained in position/alignment using pins 212, which may be alignable with corresponding apertures in the part-attachment tool 210. In other aspects, the part-attachment tool 210 may be configured with one or more additional part-processing tools provided in a combined or distributed arrangement (e.g., one or more additional heat application tools, cutting tools, welding tools, adhesive application tools, etc.).

In one aspect, the part-attachment tool 210 may be configured to provide heat sufficient to bond the connecting portion 172 to the flat pattern upper 118 without reaching a temperature that degrades the materials of the connecting portion 172 or the flat pattern upper 118. As a result, thermal bonding may be achieved without compromising the materials or construction of an article of footwear. Additionally, the temperature of deformation of the connecting portion 172 or the backing portion 196 may be lower than the temperature of deformation of the flat pattern upper 118 to allow bonding to occur without deforming the flat pattern upper 118.

Figure 8A:
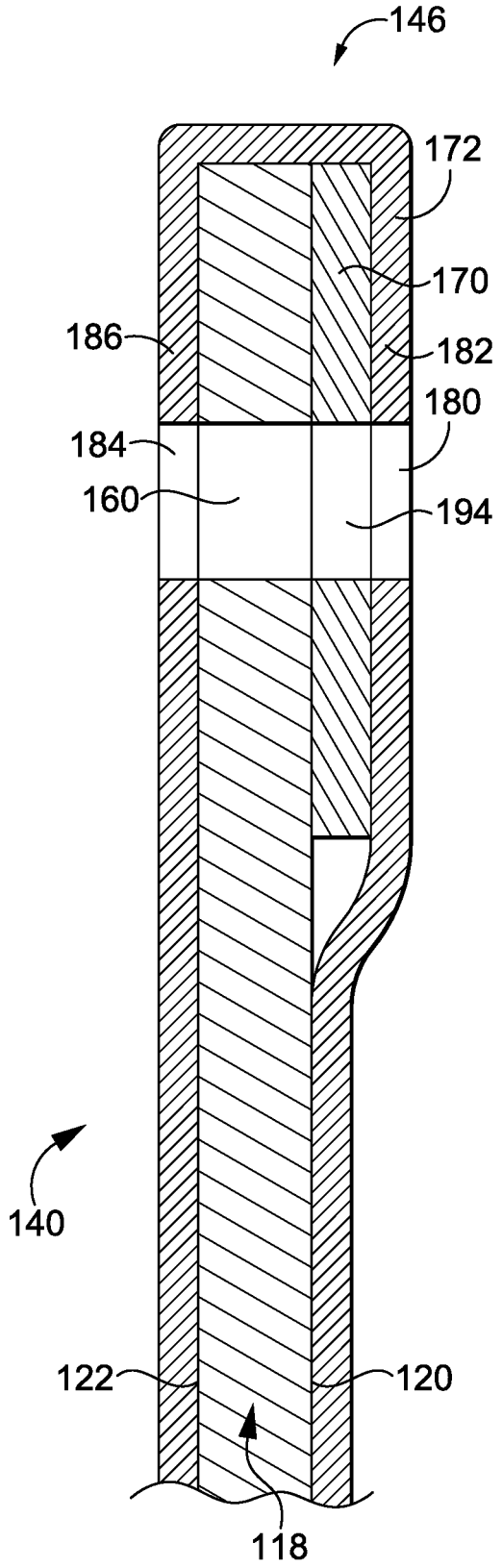
FIG. 8A depicts a cross-section view of the medial side closing of the dimensional article of footwear in FIG. 4A, in accordance with an aspect hereof.

Referring to FIG. 8A, a cross-section view of the dimensional article of footwear 140 of FIG. 4A showing the connecting portion 172 layered over and attached to the flat pattern upper 118 at the medial side closing 146 is provided, in accordance with an aspect hereof. As depicted in FIG. 8A, the top surface 120, the bottom surface 122, and the throat edge 150 have been overlaid by the folded-over connecting portion 172, which also partially covers the throat overlay 170 that is positioned between the connecting portion 172 and the flat pattern upper 118. This provides a secured format at the medial side closing 146. Additionally, as shown in FIG. 8A, the first aperture 160 of the flat pattern upper 118 is at least partially aligned with a corresponding one of the first pair of apertures 180 in the first part 182 of the connecting portion 172, and also, with a corresponding one of the second pair of apertures 184 in the second part 186 of the connecting portion 172. One of the throat apertures 194 in the throat overlay 170 is also aligned with the first aperture 160. This stacked configuration of materials may be secured through use of adhesive bonding, heat bonding, pressure bonding, stitching, welding, and the like. For example, the connecting portion 172 may be formed from a material that melts at a particular temperature of deformation that is lower than the temperature of deformation of a material that forms the flat pattern upper 118, allowing the connecting portion 172 to form a secure bond with the flat pattern upper 118 when the particular temperature of deformation is achieved.

Figure 8B:
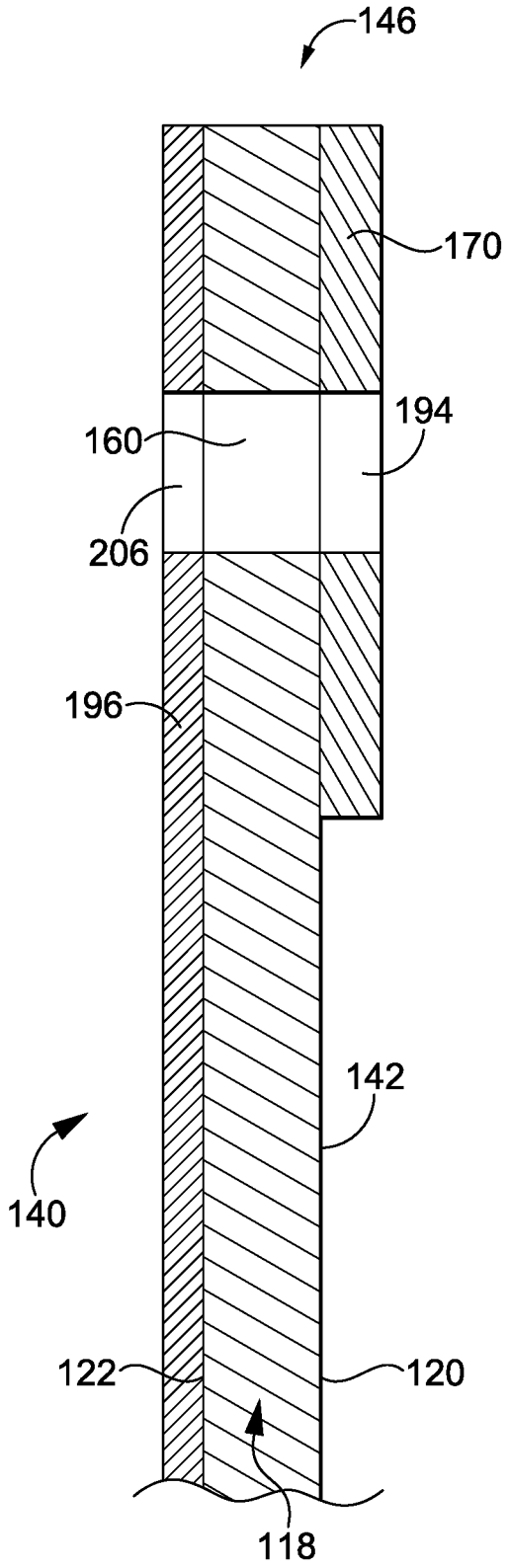
FIG. 8B depicts a cross-section view of the medial side closing of the dimensional article of footwear in FIG. 5A, in accordance with an aspect hereof.

Referring to FIG. 8B, similarly, a cross-section view of the dimensional article of footwear 140 of FIG. 5A, showing the backing portion 196 attached to the flat pattern upper 118 at the medial side closing 146, is provided, in accordance with an aspect hereof. As shown from FIG. 8B, the backing portion 196 is attached to the bottom surface 122 of the flat pattern upper 118, allowing the medial side closing 146 to be secured. In the aspect depicted in FIG. 5A and FIG. 8B, the throat overlay 170 is exposed on the exterior portion 142. Additionally, one of the pair of throat apertures 194, the first aperture 160 of the flat pattern upper 118, and one of the first pair of mating apertures 206 are at least partially aligned to provide a path through the layered materials.

Figure 9:
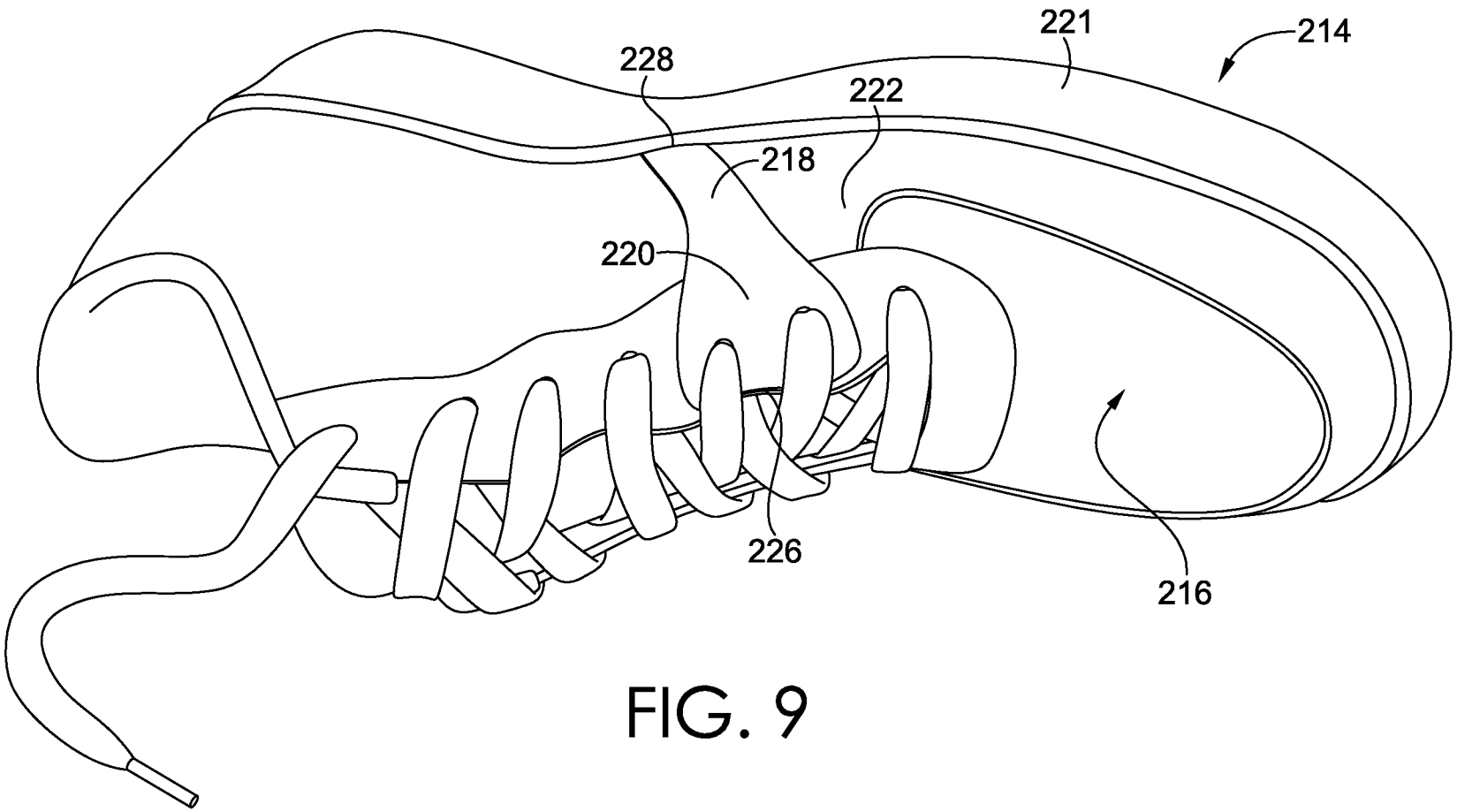
FIG. 9 depicts a dimensional article of footwear formed from a flat pattern upper with a sole attached, in accordance with an aspect hereof.

Referring to FIG. 9, a dimensional article of footwear 214 formed from a flat pattern upper 216 is provided, in accordance with an aspect hereof. The dimensional article of footwear 214 includes a medial side closing 218. A backing portion 220 is layered over and secured to an exterior portion 222 of the dimensional article of footwear 214 along the medial side closing 218. Additionally, as shown in FIG. 9, a sole 221, or a portion thereof, has been secured to the underfoot portion of the dimensional article of footwear 214. The backing portion 220 extends from a throat edge 226 of the flat pattern upper 216 to a perimeter edge 228 of the flat pattern upper 216, being further secured at least partially by the sole 221 at the perimeter edge 228. As noted elsewhere herein, aperture alignment may be used to align the backing portion 220 with the medial side closing 218. The backing portion 220 may be at least partially covered, obscured, and/or secured by the sole 221 near the perimeter edge 228, as shown in the exemplary aspect depicted in FIG. 9. In comparison to other aspects depicted herein (e.g., as in FIG. 5A and FIG. 5B), the dimensional article of footwear 214 shown in FIG. 9 may represent an article at a position further downstream in a manufacturing and assembly process.

Exemplary Method of Manufacturing an Article of Footwear Having a Side Seam

Referring to FIG. 10, a block diagram of an exemplary method 1000 of manufacturing an article of footwear having a side seam from a flat pattern is provided, in accordance with an aspect hereof. At a block 1010, a flat pattern upper, such as the flat pattern upper 118 depicted in FIG. 2, having a top surface and an opposite bottom surface, such as the top surface 120 and the bottom surface 122 depicted in FIG. 2, a toe end and an opposite heel end, such as the toe end 124 and the heel end 126 depicted in FIG. 2, and a medial side and an opposite lateral side, such as the medial side 128 and the lateral side 130 depicted in FIG. 2, is formed. At a block 1020, one or more apertures are formed in the flat pattern upper, such as the first, second, third, and fourth apertures 160, 164, 166, 168 depicted in FIG. 3. At a block 1030, the flat pattern upper is formed into a dimensional article of footwear, such as the dimensional article of footwear 140 depicted in FIG. 3, with the top surface forming an exterior portion, such as the exterior portion 142 shown in FIG. 3, of the dimensional article of footwear.

At a block 1040, a side closing, such as the medial side closing 146 depicted in FIG. 4A, is formed by adjoining a first side edge, such as the first medial edge 136 depicted in FIG. 3, and a second side edge, such as the second medial edge 138 depicted in FIG. 3, of the flat pattern upper. At a block 1050, a connecting portion, such as the connecting portion 172 depicted in FIG. 4B, having one or more apertures, such as the first, second, third, and fourth pairs of apertures 180, 184, 190, 192 depicted in FIG. 4A, that are alignable with the one or more apertures formed in the flat pattern upper is provided. At a block 1060, the connecting portion is aligned with the side closing by aligning the one or more apertures in the connecting portion with the one or more apertures formed in the flat pattern upper. At a block 1070, the aligned connecting portion is secured to the flat pattern upper adjacent the first side edge and the second side edge, such as using one of the methods or processes described herein.

Aligning Flat Pattern Pieces for Assembly Using Multi-Purpose Apertures

In addition to facilitating the alignment of a securing element with a side closing (e.g., a medial side closing as shown in FIG. 4A and FIG. 5A), apertures formed in a flat pattern upper may provide multi-purpose functionality. For example, a flat pattern upper may include apertures that are functional (e.g., lacing apertures, ventilation apertures, etc.) that are also useable for alignment and registration of flat pattern pieces during the assembly process. Additionally, apertures used for alignment with one flat pattern piece may also be used for alignment with other flat pattern pieces. Accordingly, this re-using and/or re-purposing of apertures may facilitate assembly of an article of footwear from flat pattern pieces with fewer manufacturing-specific modifications (e.g., apertures, features, and/or structures formed specifically for assembly of the parts).

The alignment and registration of the flat pattern pieces may be facilitated through use of one or more registration tools. Each registration tool may include pins spaced for engagement with aligned apertures of flat pattern pieces being assembled. For example, a registration tool may have pins spaced to engage apertures of a tongue portion and also corresponding apertures of a flat pattern upper that are aligned with the apertures of the tongue portion, allowing the position of those pieces relative to each other to be at least partially maintained in the assembly and/or attachment process (e.g., allowing one or more joining processes to be applied to the aligned parts). Additionally, a registration tool may have pins spaced to engage aligned apertures of a flat pattern collar portion and corresponding apertures of a flat pattern upper, allowing the position of those pieces relative to each other to be maintained in the assembly and/or attachment process. In this respect, different registration tools may be used for the alignment and registration of different pieces with a flat pattern upper, depending on spacing requirements of the apertures, among other factors.

Figure 11A:
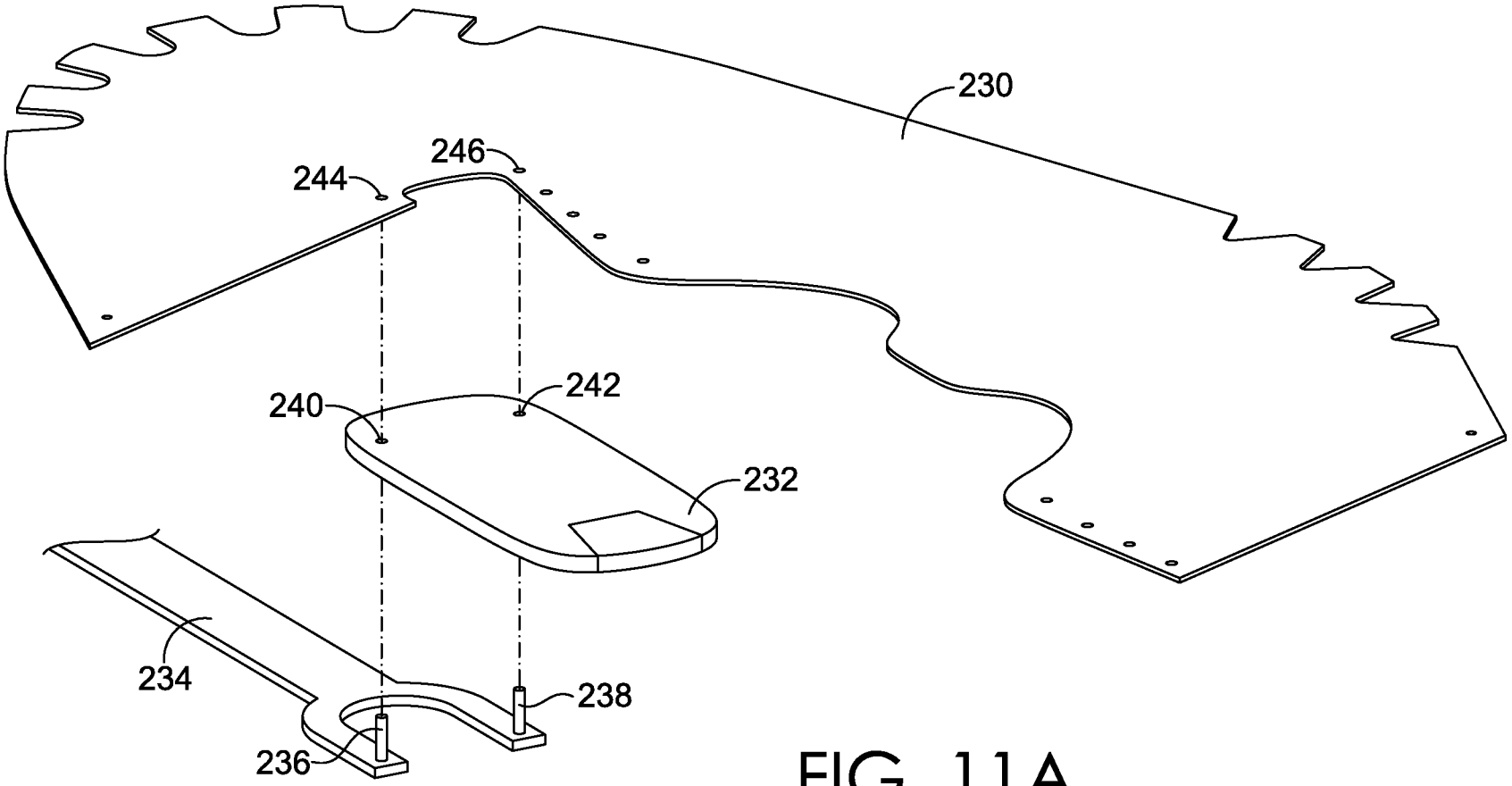
FIG. 11A depicts an exploded view of a flat pattern upper and a flat pattern tongue portion aligned for attachment using a registration tool, in accordance with an aspect hereof.

Referring to FIG. 11A, an exploded view of a flat pattern upper 230 and a flat pattern tongue portion 232 aligned for attachment using a registration tool 234 is provided, in accordance with an aspect hereof. The registration tool 234 includes first and second pins 236, 238. The first pin 236 is positioned for engagement with a first tongue aperture 240 in the flat pattern tongue portion 232 and with a first lacing aperture 244 in the flat pattern upper 230. The second pin 238 is positioned for engagement with a second tongue aperture 242 in the flat pattern tongue portion 232 and a second lacing aperture 246 in the flat pattern upper 230.

Figure 11B:
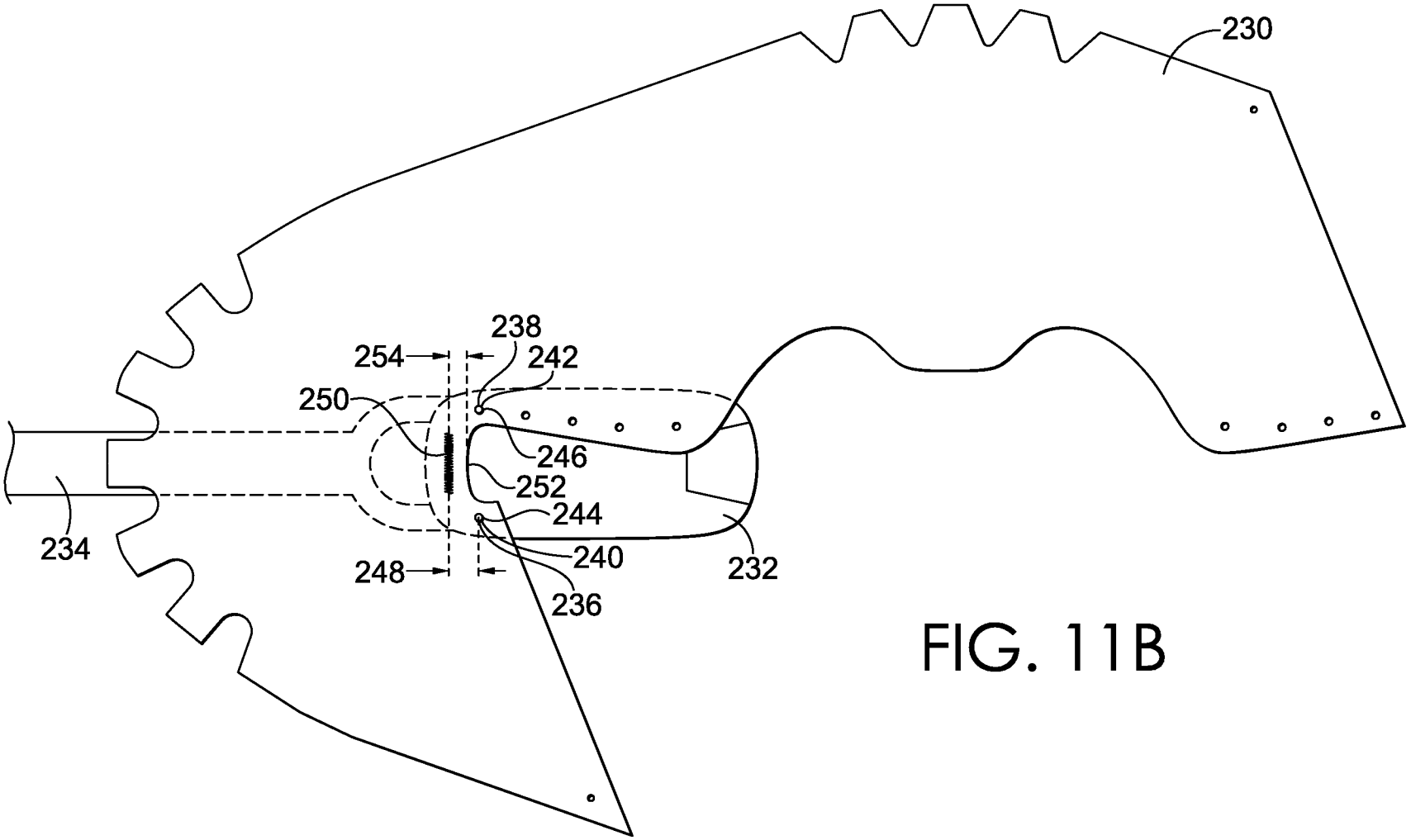
FIG. 11B depicts a top-down elevation view of the flat pattern upper and the flat pattern tongue portion of FIG. 11A aligned for attachment on the registration tool, in accordance with an aspect hereof.

Using the registration tool 234, the flat pattern upper 230 and the flat pattern tongue portion 232 may be brought together in alignment so that further assembly processes may be applied (e.g., attachment of the pieces by stitching, welding, adhering, and/or other bonding, etc.). The first and second tongue apertures 240, 242 are also formed and spaced such that they provide an overlay of material between the flat pattern upper 230 and the flat pattern tongue portion 232 as shown in FIG. 11B when in alignment. The first and second tongue apertures 240, 242 may also be formed and/or positioned such that, upon assembly of the corresponding article of footwear, the first and second tongue apertures 240, 242 are at least partially obscured by other materials forming the article (e.g., such as the flat pattern upper in the dimensional state).

Referring to FIG. 11B, a top-down elevation view of the flat pattern upper 230 and the flat pattern tongue portion 232 of FIG. 11A aligned for attachment on the registration tool 234 is provided, in accordance with an aspect hereof. In FIG. 11B, the first tongue aperture 240 and the first lacing aperture 244 are at least partially aligned with each other using the first pin 236, and the second tongue aperture 242 and the second lacing aperture 246 are at least partially aligned with each other using the second pin 238. The alignment of the first and second tongue apertures 240, 242 with the respective first and second lacing apertures 244, 246 allows for a defined overlap of material between the flat pattern tongue portion 232 and the flat pattern upper 230. This alignment provides a defined spacing 248 from the first and second tongue apertures 240, 242 to an attachment location 250 at which the flat pattern tongue portion 232 and the flat pattern upper 230 can be secured to each other (e.g., using stitching, welding, adhesive, other bonding, etc.). Also due to the alignment, the exemplary attachment location 250 is spaced from a U-throat edge 252 of the flat pattern upper 230 by a defined spacing 254. As a result, proper registration of the flat pattern tongue portion 232 with the flat pattern upper 230 for attachment can be provided.

Figure 12A:
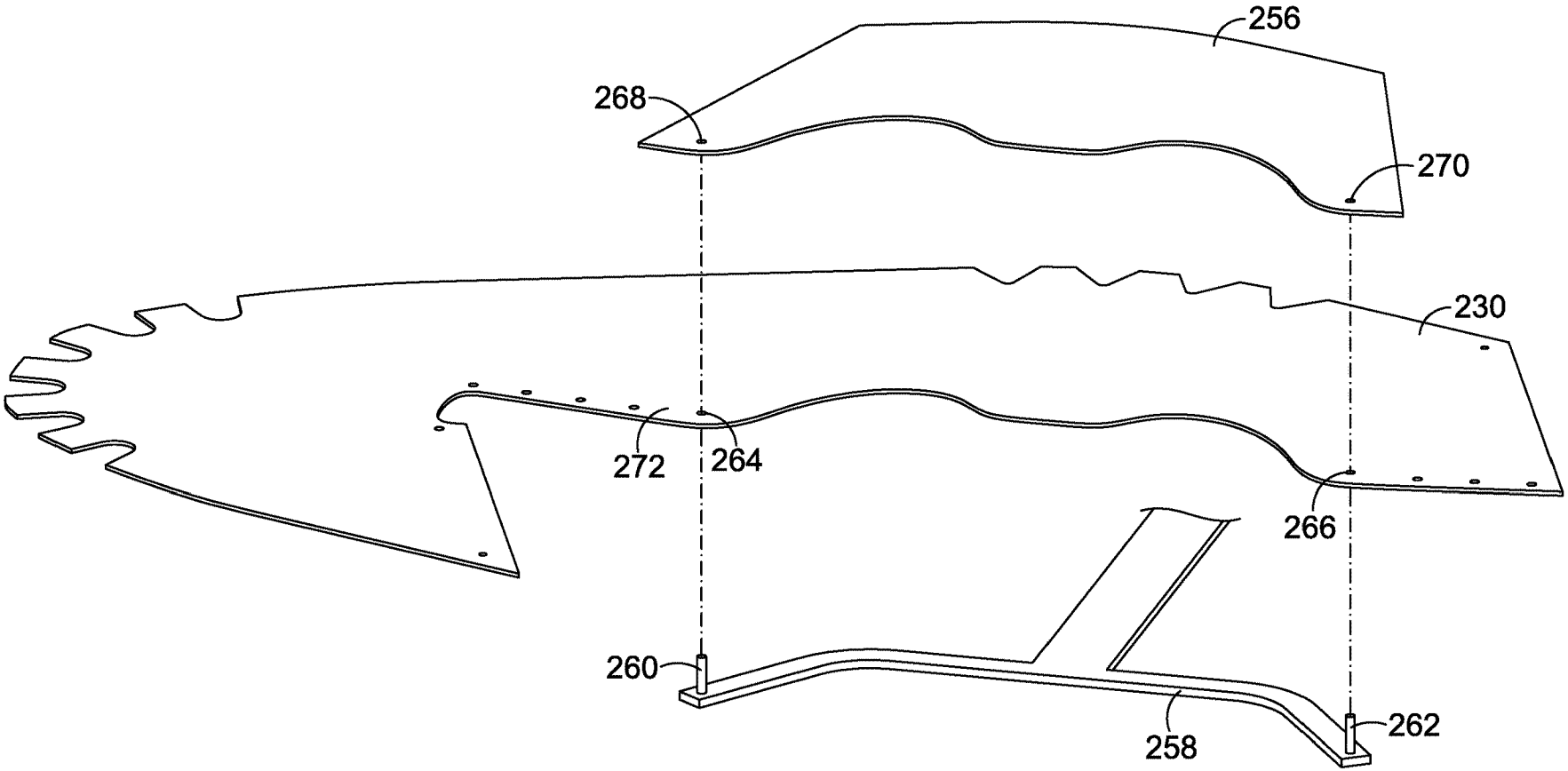
FIG. 12A depicts an exploded view of a flat pattern upper and a flat pattern collar portion aligned for attachment on another registration tool, in accordance with an aspect hereof.

Referring to FIG. 12A, an exploded view of the flat pattern upper 230 and a flat pattern collar portion 256 aligned for attachment on a registration tool 258 is provided, in accordance with an aspect hereof. In FIG. 12A, the flat pattern upper 230 of FIGS. 11A-11B is shown positioned for alignment with the flat pattern collar portion 256 on the registration tool 258. The registration tool 258 includes first and second pins 260, 262 that are spaced for respective alignment with first and second flat pattern upper apertures 264, 266, and also, for respective alignment with first and second collar apertures 268, 270 in the flat pattern collar portion 256. This once again allows alignment of the parts to be at least partially maintained through additional assembly processes.

Figure 12B:
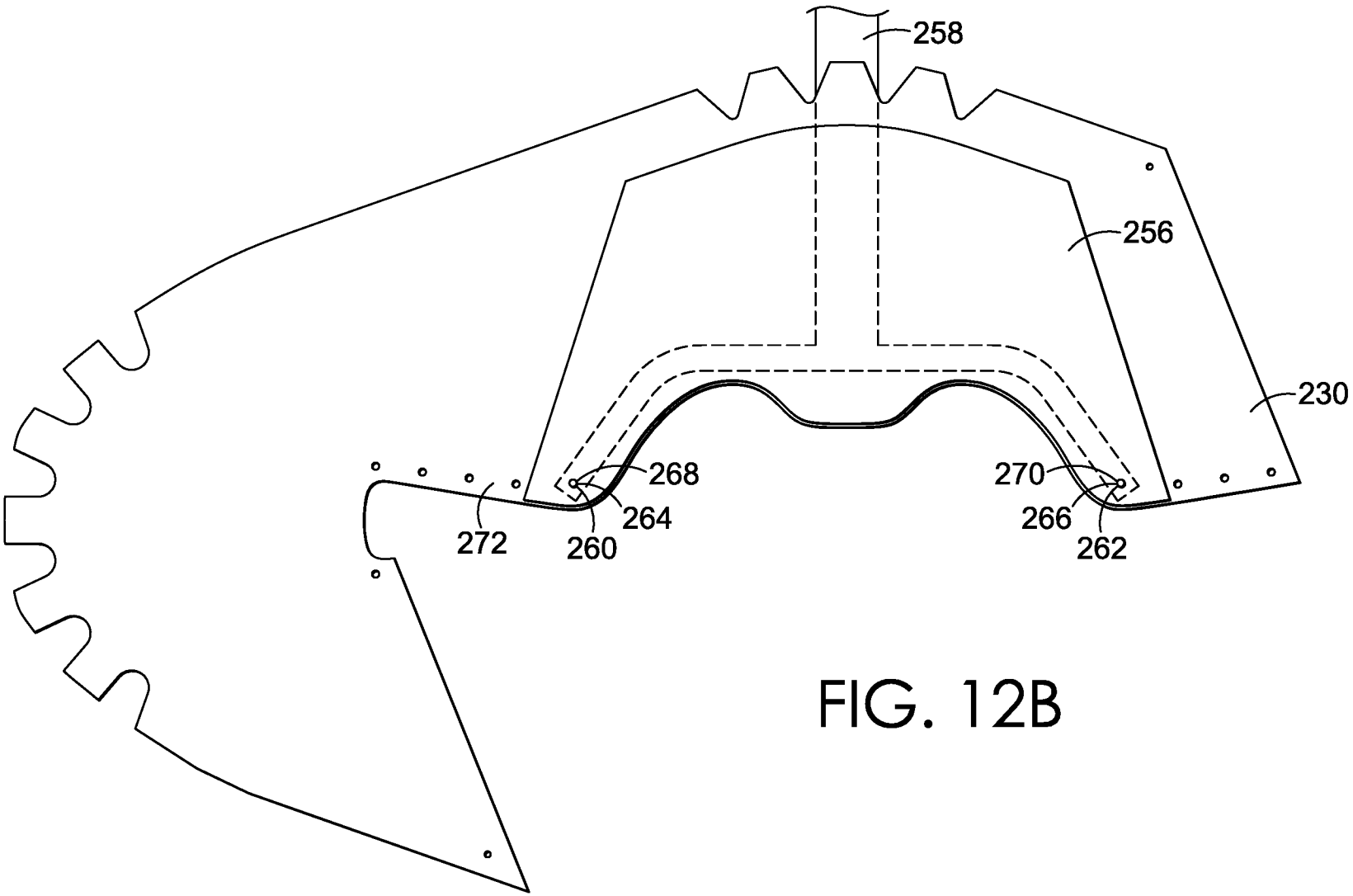
FIG. 12B depicts a top-down elevation view of the flat pattern upper and the flat pattern collar portion of FIG. 12A aligned for attachment on the registration tool, in accordance with an aspect hereof.

To facilitate alignment of the flat pattern pieces for assembly while also limiting a number of manufacturing-specific modifications made to the pieces, the first and second collar apertures 268, 270 may be formed and spaced to align with apertures on the flat pattern upper used for other purposes. For example, as shown in FIGS. 12A-12B, the first collar aperture 268 aligns with the first flat pattern upper aperture 264, which may also be used as a lacing aperture in a dimensional article of footwear formed from the assembled pieces (e.g., formed along the throat area 272). The second collar aperture 270 aligns with the second flat pattern upper aperture 266, which may be formed in the flat pattern upper 230 for alignment of a securing element used to secure a medial side closing of the dimensional article of footwear formed from the assembled pieces (e.g., such as the second aperture 164 shown in FIG. 3). In this sense, alignment of the flat pattern collar portion 256, or any other flat pattern piece, with the flat pattern upper 230 may use, at least in part, pre-existing apertures and/or multi-use apertures formed in the flat pattern upper 230. This re-use or multi-use of apertures may limit a number of modifications that may need to be made to flat pattern uppers for assembly purposes.

Referring to FIG. 12B, a top-down elevation view of the flat pattern upper 230 and the flat pattern collar portion 256 of FIG. 12A aligned for attachment on the registration tool 258 is provided, in accordance with an aspect hereof. FIG. 12B more clearly depicts the alignment of the first flat pattern upper aperture 264 and the first collar aperture 268 using the first pin 260, and also, the alignment of the second flat pattern upper aperture 266 and the second collar aperture 270 using the second pin 262. Once again, the alignment of the flat pattern collar portion 256 using apertures formed for functional purposes and/or for alignment of other parts may facilitate the assembly of an article of footwear from various flat pattern pieces while limiting the number of manufacturing-specific modifications that need to be made to the flat pattern pieces.

Furthermore, it should be noted that although FIGS. 11A-11B and 12A-12B depict a flat pattern upper configured to form a medial side closing, the alignment and registration methods discussed herein may also be used to provide alignment of flat pattern pieces in an article of footwear having a lateral side closing.

In another aspect hereof, a dimensional article of footwear formed from multiple flat pattern pieces aligned and registered for attachment to each other using aperture alignment is provided. The dimensional article includes a flat pattern upper with one or more apertures. The dimensional article further includes one or more flat pattern pieces that each include one or more apertures. At least some of the apertures of each flat pattern piece are aligned with at least some of the apertures of the flat pattern upper, providing alignment and registration of the attached flat pattern pieces with the flat pattern upper. In additional aspects, one or more apertures of the flat pattern upper are aligned with one or more apertures of multiple different flat pattern pieces attached to the flat pattern upper to form the dimensional article of footwear, and/or one or more apertures of a flat pattern piece attached to the flat pattern upper are aligned with one or more apertures of another flat pattern piece also aligned with the flat pattern upper to form the dimensional article of footwear.

In another aspect hereof, a method of forming a dimensional article of footwear from multiple flat pattern pieces that are aligned and registered with each other for attachment using aperture alignment is provided. The method includes providing a flat pattern upper with one or more apertures, providing one or more flat pattern pieces that each include one or more apertures, aligning at least some of the apertures of each of the one or more flat pattern pieces with at least some of the apertures of the flat pattern upper to provide alignment and registration of the flat pattern pieces. The method may further comprise attaching the aligned parts to each other and forming the attached aligned parts into a dimensional article of footwear. In additional aspects, one or more apertures in the flat pattern upper may be aligned with one or more apertures of multiple different flat pattern pieces for attachment, and/or one or more apertures in a flat pattern piece attached to the flat pattern upper may be aligned with one or more apertures of another flat pattern piece also aligned with the flat pattern upper for attachment.

From the foregoing, it will be seen that the invention is one well adapted to attain all the ends and objects hereinabove set forth together with other advantages, which are obvious and which are inherent to the structure. It will be understood that certain features and sub-combinations are of utility and may be employed without reference to other features and sub-combinations. This is contemplated by and is within the scope of the claims. While the subject matter of this disclosure is illustrated herein with specific examples, variations within the scope of the claims are possible and contemplated.

What is claimed is:

1. A method of manufacturing an article of footwear with a side seam from a flat pattern, the method comprising:

forming a flat pattern upper having a top surface and an opposite bottom surface, a toe end and an opposite heel end, and a medial side and an opposite lateral side;

forming a first aperture in the flat pattern upper;

forming the flat pattern upper into a dimensional article of footwear with the top surface forming an exterior portion of the dimensional article of footwear;

forming a side closing by adjoining a first side edge and a second side edge of the flat pattern upper;

forming a connecting portion having a first aperture that is alignable with the first aperture of the flat pattern upper;

aligning the connecting portion with the side closing by aligning at least the first aperture of the connecting portion with the first aperture of the flat pattern upper; and securing the aligned connecting portion to the flat pattern upper adjacent the first side edge and the second side edge, wherein the first aperture of the connecting portion and the first aperture of the flat pattern upper that are aligned define a first functional aperture of the article of footwear.

2. The method of manufacturing of claim 1, wherein the side closing comprises a medial side closing with the first side edge comprising a first medial edge of the flat pattern upper and the second side edge comprising a second medial edge of the flat pattern upper.

3. The method of manufacturing of claim 1, further comprising forming a second aperture in the flat pattern upper, wherein the connecting portion includes a second aperture that is alignable with the second aperture of the flat pattern upper, and wherein the second aperture of the connecting portion and the second aperture of the flat pattern upper are aligned to define a second functional aperture of the article of footwear.

4. The method of manufacturing of claim 3, wherein the first aperture of the flat pattern upper is formed on a first side of the side closing, and wherein the second aperture of the flat pattern upper is formed on a second side of the side closing.

5. The method of manufacturing of claim 1, further comprising:

forming a throat overlay having a first throat aperture that is alignable with the first aperture of the connecting portion and the first aperture of the flat pattern upper;

aligning the throat overlay with a throat edge of the flat pattern upper by aligning at least the first throat aperture, the first aperture of the connecting portion, and the first aperture of the flat pattern upper; and securing the aligned throat overlay to the flat pattern upper and to the connecting portion, wherein the connecting portion once secured at least partially overlays the throat overlay.

6. The method of manufacturing of claim 1, wherein securing the aligned connecting portion to the flat pattern upper comprises thermally bonding the connecting portion to the flat pattern upper, and wherein a temperature of deformation of a material forming the connecting portion is lower than a temperature of deformation of a material forming the flat pattern upper.

7. The method of manufacturing of claim 1, wherein, when the article of footwear is in an assembled state, the first functional aperture is exposed.

8. The method of manufacturing of claim 1, wherein the first functional aperture comprises a lacing aperture.

9. The method of manufacturing of claim 1, wherein the first functional aperture comprises a ventilation aperture.

10. A method of manufacturing an article of footwear with a side seam from a flat pattern, the method comprising:

forming a flat pattern upper having a top surface and an opposite bottom surface, a toe end and an opposite heel end, and a medial side and an opposite lateral side;

forming a first aperture in the flat pattern upper;

forming the flat pattern upper into a dimensional article of footwear with the top surface forming an exterior portion of the dimensional article of footwear;

forming a side closing by adjoining a first side edge and a second side edge of the flat pattern upper;

forming a connecting portion having a first aperture that is alignable with the first aperture of the flat pattern upper;

forming a throat overlay having a first throat aperture that is alignable with the first aperture of the flat pattern upper and the first aperture of the connecting portion;

aligning the throat overlay, the connecting portion, and the flat pattern upper by aligning the first throat aperture, the first aperture of the connecting portion, and the first aperture of the flat pattern upper; and securing the throat overlay, the connecting portion, and the flat pattern upper together such that the throat overlay at least partially covers the connecting portion.

* * * * *